US008206215B2

(12) United States Patent
Moyle et al.

(10) Patent No.: US 8,206,215 B2
(45) Date of Patent: Jun. 26, 2012

(54) GAMING MACHINE SYSTEMS AND METHODS WITH MEMORY EFFICIENT HISTORICAL VIDEO RE-CREATION

(75) Inventors: Gregory Allen Moyle, Reno, NV (US); Gregory Schlottman, Sparks, NV (US)

(73) Assignee: IGT, Reno, NV (US)

( * ) Notice: Subject to any disclaimer, the term of this patent is extended or adjusted under 35 U.S.C. 154(b) by 1229 days.

(21) Appl. No.: 11/515,329

(22) Filed: Aug. 31, 2006

(65) Prior Publication Data

US 2008/0076546 A1 Mar. 27, 2008

(51) Int. Cl.
*A63F 9/24* (2006.01)

(52) U.S. Cl. ..... 463/29

(58) Field of Classification Search ..... 436/29
See application file for complete search history.

(56) References Cited

U.S. PATENT DOCUMENTS

| | | | | |
|---|---|---|---|---|
| 1,087,252 | A * | 2/1914 | Muzzy | 346/33 R |
| 4,237,483 | A | 12/1980 | Clever | |
| 4,283,709 | A | 8/1981 | Lucero et al. | |
| 4,448,419 | A * | 5/1984 | Telnaes | 463/21 |
| 4,521,014 | A | 6/1985 | Sitrick | |
| 4,607,844 | A | 8/1986 | Fullerton | |
| 4,710,873 | A | 12/1987 | Breslow et al. | |
| 4,782,468 | A | 11/1988 | Jones et al. | |
| 4,948,138 | A | 8/1990 | Pease et al. | |
| 5,127,651 | A | 7/1992 | Okada | |
| 5,175,731 | A | 12/1992 | Suarez | |
| 5,273,294 | A | 12/1993 | Amanai | |
| 5,278,643 | A | 1/1994 | Takemoto et al. | |
| 5,395,242 | A | 3/1995 | Slye et al. | |
| 5,397,133 | A | 3/1995 | Penzias | |
| 5,643,086 | A | 7/1997 | Alcorn et al. | |
| 5,702,303 | A | 12/1997 | Takemoto et al. | |
| 5,761,647 | A | 6/1998 | Boushy | |
| 5,770,533 | A | 6/1998 | Franchi | |
| 5,797,795 | A | 8/1998 | Takemoto et al. | |
| 5,810,665 | A | 9/1998 | Takemoto et al. | |
| 5,816,918 | A | 10/1998 | Kelly et al. | |
| 5,816,922 | A | 10/1998 | Nakajima | |
| 5,917,725 | A | 6/1999 | Thacher et al. | |

(Continued)

FOREIGN PATENT DOCUMENTS

AU 2003246322 4/2004

(Continued)

OTHER PUBLICATIONS

International Search Report and Written Opinion dated Jun. 30, 2005 from corresponding PCT application US 2005/001063 (13 pages).

(Continued)

*Primary Examiner* — Corbett B Coburn
(74) *Attorney, Agent, or Firm* — Weaver Austin Villeneuve & Sampson LLP

(57) ABSTRACT

The present invention provides employs a multi-phase process that improves historical capture and video playback on gaming machines. The first phase occurs during game creation and production, where video data required for video re-creation and playback is identified for each scene or frame in a game where a designer seeks playback capability. The second phase occurs during game play. Historical game re-creation software on the gaming machine knows what data in each frame is needed for historical video re-creation of the frame, and saves this data. The third phase occurs during re-capture and playback, where the data is recalled from memory to enable video playback at the particular instance of interest.

44 Claims, 11 Drawing Sheets

U.S. PATENT DOCUMENTS

| | | | | |
|---|---|---|---|---|
| 5,947,821 | A | 9/1999 | Stone | |
| 5,966,715 | A | 10/1999 | Sweeney et al. | |
| 5,970,143 | A | 10/1999 | Schneier et al. | |
| 5,971,851 | A | 10/1999 | Pascal et al. | |
| 5,997,401 | A | 12/1999 | Crawford | |
| 6,012,982 | A | 1/2000 | Piechowiak et al. | |
| 6,018,720 | A | 1/2000 | Fujimoto | |
| 6,021,196 | A | 2/2000 | Sandford, II et al. | |
| 6,068,552 | A | 5/2000 | Walker et al. | |
| 6,071,190 | A | 6/2000 | Weiss et al. | |
| 6,089,975 | A | 7/2000 | Dunn | |
| 6,104,815 | A | 8/2000 | Alcorn et al. | |
| 6,106,396 | A | 8/2000 | Alcorn et al. | |
| 6,110,043 | A | 8/2000 | Olsen | |
| 6,115,532 | A | 9/2000 | Saeki | |
| 6,117,013 | A | 9/2000 | Eiba | |
| 6,120,379 | A | 9/2000 | Tanaka et al. | |
| 6,131,192 | A | 10/2000 | Henry | |
| 6,142,876 | A | 11/2000 | Cumbers | |
| 6,149,522 | A | 11/2000 | Alcorn et al. | |
| 6,167,562 | A | 12/2000 | Kaneko | |
| 6,219,836 | B1 | 4/2001 | Wells et al. | |
| 6,224,485 | B1 | 5/2001 | Dickinson et al. | |
| 6,231,443 | B1 | 5/2001 | Asai et al. | |
| 6,234,900 | B1 | 5/2001 | Cumbers | |
| 6,270,412 | B1 | 8/2001 | Crawford et al. | |
| 6,302,793 | B1 | 10/2001 | Fertitta et al. | |
| 6,306,038 | B1 | 10/2001 | Graves et al. | |
| 6,319,125 | B1 | 11/2001 | Acres | |
| 6,322,451 | B1 | 11/2001 | Miura | |
| 6,336,865 | B1 | 1/2002 | Kinjo | |
| 6,350,199 | B1 | 2/2002 | Williams et al. | |
| 6,357,042 | B2 | 3/2002 | Srinivasan et al. | |
| 6,371,852 | B1 | 4/2002 | Acres | |
| 6,379,245 | B2 | 4/2002 | De Keller | |
| 6,404,418 | B1 | 6/2002 | Leem | |
| 6,409,602 | B1 | 6/2002 | Wiltshire et al. | |
| 6,421,738 | B1 | 7/2002 | Rattan et al. | |
| 6,425,825 | B1 | 7/2002 | Sitrick | |
| 6,435,969 | B1 | 8/2002 | Tanaka et al. | |
| 6,438,696 | B1 | 8/2002 | Barran et al. | |
| 6,446,119 | B1 | 9/2002 | Olah et al. | |
| 6,477,251 | B1 * | 11/2002 | Szrek et al. | 380/46 |
| 6,527,638 | B1 | 3/2003 | Walker et al. | |
| 6,533,662 | B2 | 3/2003 | Soltys et al. | |
| 6,554,704 | B2 | 4/2003 | Nicastro et al. | |
| 6,577,733 | B1 | 6/2003 | Charrin | |
| 6,595,856 | B1 | 7/2003 | Ginsburg et al. | |
| 6,626,761 | B1 | 9/2003 | Okada | |
| 6,641,484 | B2 | 11/2003 | Oles et al. | |
| 6,675,382 | B1 | 1/2004 | Foster | |
| 6,682,425 | B2 | 1/2004 | Nakayama | |
| 6,692,361 | B1 | 2/2004 | Itskov | |
| 6,780,106 | B2 | 8/2004 | DeMar et al. | |
| 6,863,608 | B1 | 3/2005 | LeMay et al. | |
| 6,887,157 | B2 | 5/2005 | LeMay et al. | |
| 6,918,831 | B2 | 7/2005 | Nguyen et al. | |
| 6,926,605 | B2 | 8/2005 | Nguyen et al. | |
| 7,076,495 | B2 | 7/2006 | Dutta et al. | |
| 7,384,339 | B2 | 6/2008 | LeMay et al. | |
| 7,563,166 | B2 | 7/2009 | Nguyen et al. | |
| 7,725,010 | B2 | 5/2010 | Seo et al. | |
| 7,891,005 | B1 | 2/2011 | Baluja et al. | |
| 2001/0044337 | A1 | 11/2001 | Rowe et al. | |
| 2002/0111207 | A1 | 8/2002 | Lind et al. | |
| 2002/0147047 | A1 | 10/2002 | Letovsky et al. | |
| 2002/0151363 | A1 | 10/2002 | Letovsky et al. | |
| 2002/0196342 | A1 | 12/2002 | Walker et al. | |
| 2003/0060286 | A1 | 3/2003 | Walker et al. | |
| 2003/0195037 | A1 | 10/2003 | Vuong et al. | |
| 2003/0195043 | A1 | 10/2003 | Shinners et al. | |
| 2003/0228906 | A1 | 12/2003 | Walker et al. | |
| 2004/0015554 | A1 | 1/2004 | Wilson | |
| 2004/0053674 | A1 | 3/2004 | Nguyen et al. | |
| 2004/0147314 | A1 * | 7/2004 | LeMay et al. | 463/30 |
| 2005/0075154 | A1 | 4/2005 | Bordes et al. | |
| 2006/0035703 | A1 | 2/2006 | Nguyen et al. | |
| 2006/0035708 | A1 | 2/2006 | Nguyen et al. | |
| 2006/0178188 | A1 | 8/2006 | LeMay et al. | |
| 2008/0119276 | A1 | 5/2008 | Alderucci | |
| 2009/0036190 | A1 | 2/2009 | Brosnan et al. | |

FOREIGN PATENT DOCUMENTS

| | | |
|---|---|---|
| DE | 19756693 | 6/1999 |
| EP | 1539312 | 6/2005 |
| EP | 1711923 | 10/2006 |
| GB | 2356483 | 5/2000 |
| GB | 2345862 | 7/2000 |
| GB | 2393027 | 3/2004 |
| RU | 2304011 | 8/2007 |
| WO | 01/41892 | 6/2001 |
| WO | 2005/071627 | 8/2005 |

OTHER PUBLICATIONS

US Notice of Allowance dated Mar. 14, 2005 from U.S. Appl. No. 10/243,464.

US Office Action dated Sep. 23, 2004 from U.S. Appl. No. 10/243,464.

US Advisory Action dated Jun. 29, 2004 from U.S. Appl. No. 10/243,464.

US Office Action dated Mar. 18, 2004 from U.S. Appl. No. 10/243,464.

US Office Action dated Nov. 6, 2003 from U.S. Appl. No. 10/243,464.

International Search Report dated Jan. 27, 2004 from Application No. PCT/US03/27130.

U.S. Office Action dated Oct. 21, 2009 from U.S. Appl. No. 11/181,662.

U.S. Final Office Action dated Jun. 16, 2010 from U.S. Appl. No. 11/181,662.

US Notice of Allowance dated Oct. 18, 2004 from U.S. Appl. No. 09/689,498.

US Advisory Action dated Apr. 19, 2004 from U.S. Appl. No. 09/689,498.

US Interview Summary dated Mar. 17, 2004 from U.S. Appl. No. 09/689,498.

US Office Action dated Jan. 13, 2004 from U.S. Appl. No. 09/689,498.

US Office Action dated Jun. 25, 2003 from U.S. Appl. No. 09/689,498.

US Office Action dated Jan. 15, 2003 from U.S. Appl. No. 09/689,498.

US Interview Summary dated Nov. 8, 2002 from U.S. Appl. No. 09/689,498.

US Office Action dated Aug. 23, 2002 from U.S. Appl. No. 09/689,498.

US Notice of Allowance dated Feb. 25, 2008 from U.S. Appl. No. 10/758,828.

US Office Action dated Aug. 16, 2007 from U.S. Appl. No. 10/758,828.

US Office Action dated Jun. 1, 2007 from U.S. Appl. No. 10/758,828.

US Interview Summary dated Apr. 13, 2007 from U.S. Appl. No. 10/758,828.

US Office Action dated Dec. 19, 2006 from U.S. Appl. No. 10/758,828.

Third Party Submission dated Jul. 31, 2008 from U.S. Appl. No. 10/758,828.

EP Search Report dated Nov. 14, 2008 from EP Application No. 05705629.3.

International Preliminary Report on Patentability dated Jul. 17, 2006 from Application No. PCT/US2005/001063.

U.S. Office Action dated Apr. 13, 2009 from U.S. Appl. No. 11/387,255.

Third Party Submission dated Jul. 31, 2008 from U.S. Appl. No. 11/387,255.

U.S. Office Action dated Dec. 17, 2009 from U.S. Appl. No. 11/387,255.

US Office Action dated Nov. 14, 2003 from U.S. Appl. No. 10/243,353.

US Office Action dated Apr. 21, 2004 from U.S. Appl. No. 10/243,353.

US Advisory Action dated Jul. 2, 2004 from U.S. Appl. No. 10/243,353.
US Office Action dated Sep. 23, 2004 from U.S. Appl. No. 10/243,353.
US Office Action dated Mar. 14, 2005 from U.S. Appl. No. 10/243,353.
Australia Examination Report dated Jan. 19, 2009 from Application No. 2003246322.
US Notice of Allowance dated Apr. 2, 2009 from U.S. Appl. No. 11/181,093.
US Advisory Action dated Feb. 20, 2009 from U.S. Appl. No. 11/181,093.
US Office Action dated Dec. 10, 2008 from U.S. Appl. No. 11/181,093.
US Office Action dated Apr. 30, 2008 from U.S. Appl. No. 11/181,093.
Search Report dated Jan. 12, 2004 from Application No. GB0321515.9.
Russian Office Action dated Oct. 16, 2006 from Russian Application No. RU2005110937.
U.S. Office Action dated Sep. 20, 2011 from U.S. Appl. No. 12/187,006.

* cited by examiner

GAMING MACHINE SYSTEMS AND METHODS WITH MEMORY EFFICIENT HISTORICAL VIDEO RE-CREATION

FIELD OF THE INVENTION

This invention relates to game history preservation and video re-creation for gaming machines. More particularly, the present invention relates to systems and methods that store states of actors and permit historical re-creation of video at a particular past instance in time, such as a winning outcome.

BACKGROUND OF THE INVENTION

Technology in the gaming industry continues to evolve. Gambling machines that include a computer processor, digital video display and related computer peripheral devices are now the norm in place of older mechanically driven reel displays. One reason for increased popularity of these new digital gaming machines is the nearly endless variety of games that can be created and installed. The new digital format on these processor-driven machines has opened the door for designers to create games that were not previously possible.

For many gaming establishments and casinos, the ability to store and re-display historical instances in game play is an important feature of the new digital machines. Game history re-creation, also referred to as video 'recapture' or video re-display at a later time than initial display, has many uses. One use assists in settling disputes concerning the results of game play. A dispute may occur, for instance, when a player believes the gaming machine did not properly credit an award for a game outcome. Other uses include overcoming a malfunction in the gaming machine and overcoming a power outage that causes the gaming machine to reinitialize. Historical playback often requires screening and approval by a gaming regulatory body for a jurisdiction, which complicates implementation of historical game re-display.

Video is frequently used to reconcile a dispute. On games such as video poker or video slots for example, a visual display of game history informs all parties as to what actually happened. The video is often saved and recalled one frame at a time. Due to memory constraints, only a subset of game history frames are played backed. This may include video display of game sequence events leading to the instance at dispute. For example, for a video poker game, visual display of historical information might include a video presentation of initial cards dealt to a player (one frame), a video presentation of cards drawn (a second frame), and a video presentation of a final hand (a third frame). Additional frames may be needed for additional stages, such as more rounds of cards being drawn. Re-calling video frames in this manner requires each frame in the sequence to be stored in memory. Each frame occupies significant memory.

Many games and gaming machines now offer frequent and small wins to increase player participation. Frequent wins and storing multiple video frames for each small win multiply to excessive memory demands for historical game re-creation.

In addition, gaming systems are offering enhanced graphics and higher resolution displays. Many new games offer stream-able media. Other games use 3-D rendering where the game scenes are rather complex and unrelated in time. The added resolution, stream-able media and 3-D effects further increase memory burden on historical game re-creation.

In view of the above, it is desirable to provide new forms of historical game re-creation.

SUMMARY OF THE INVENTION

To solve these and other problems, the present invention employs a multi-phase process that improves historical capture and video playback for gaming machines. The first phase occurs during game creation and production, where video data required for video re-creation and historical playback is identified for each scene in a game where a designer seeks playback capability. In one embodiment, the game creation process defines a set of actors and states for the video data in each scene. An actor refers to a graphical item displayed on a video device whose presentation changes with time. A state describes the video presentation status of an actor at a particular instance in time.

The second phase occurs during game play. Historical game re-creation software on the gaming machine knows which actors are in each scene or frame and what data is needed for historical video re-creation of a frame. Each time a winning outcome occurs in a game for example, the software stores a state for each known actor in the frame. The states may be archived and indexed (e.g., via a number for the gaming machine and time) in memory on the gaming machine or memory operated by a remote server. In addition, video data for multiple frames leading up to the instance in question may be sampled and stored.

The third phase occurs during re-capture and playback, where the states are recalled from memory and applied to the known actors in a frame to enable re-creation of the video. The re-created video then corresponds to the stored states and in some cases is identical to the video data as it first appeared. In other instances, the re-created video may also be shrunk and translated (e.g. moved into one corner of the screen) to accommodate other historical playback objects. The stored states allow video information in one or more frames to be displayed at any time in the future.

In one aspect, the present invention relates to a method for recreating video output for a game played by a person on a gaming machine. The method includes, in response to an event of interest for the game on the gaming machine, storing a state in memory for an actor that was displayed using a video device for the gaming machine. The state describes a presentation status of the actor when the event of interest occurred. The method also includes recalling the state for the actor from the memory. The method further includes re-creating video output for the game using the state. The method additionally includes displaying the re-created video output.

In another aspect, the present invention provides a method for recreating a rendered three-dimensional video output for a game played by a person on a gaming machine.

The invention also provides a method for manufacturing a game playable on a gaming machine. The manufacturing method includes creating software for the game that allows the gaming machine to play the game; the game includes a scheme comprising a series of scenes. The method also includes designating a set of actors for each scene that allow recreation of video output for a frame that occurs during the scene. A state for each actor describes the presentation status of the actor in the frame. The method further includes re-creating video output for the frame using the set of actors and a state for each actor that corresponds to the video output for each actor in the frame.

In yet another aspect, the present invention provides a method of re-creating and playing back video previously displayed on a gaming machine.

The invention further provides computer readable medium including instructions for recreating video output for a game played by a person on a gaming machine and output when an event of interest occurred.

In still another aspect, the present invention relates to a gaming machine that provides game re-creation. The gaming machine includes an external cabinet defining an interior region of the gaming machine. The gaming machine also includes a video device adapted to display video output for the game. The gaming machine includes a memory located within the external cabinet. The memory source includes instructions for, in response to an event of interest for the game on the gaming machine, storing a state in memory for an actor displayed using a video device for the gaming machine. The gaming machine further includes a main processor disposed within the external cabinet and configured to output the game to the player using the video device and configured to a) recall the state for the actor from the memory and b) re-create the video output for the game using the state for the actor.

In still another aspect, the present invention relates to a gaming system that provides video re-creation for a game. The gaming system includes a server networked to one or more gaming machines. The server includes a server memory that stores a database and a communications interface for transmitting data to, and receiving data from, the gaming machines. At least one gaming machine on the network includes: a) a video device adapted to display video output for the game, b) a gaming machine memory including instructions for, in response to an event of interest for the game on the gaming machine, transmitting a state for an actor displayed using the video device, where the state describes a presentation status of the actor when the event of interest occurred, c) a main processor configured to output the game to the player using the video device and configured to re-create the video output for the game using the state for the actor, and d) a communications interface that permits the gaming machine to communicate across the network with a server.

These and other features and advantages of the invention will be described in more detail below with reference to the associated figures.

DESCRIPTION OF THE PREFERRED EMBODIMENTS

The present invention will now be described in detail with reference to a few preferred embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

This invention provides video re-creation systems and methods for use with gaming machines. The systems and methods store video data useful for subsequent re-creation and re-display of video output related to game play on a gaming machine. The video output usually pertains to a particular instance or event of interest in game play or video presentation. The event of interest may relate to a winning outcome, for example, that is challenged by a player some time after the win occurs and the gaming machine has moved onto new video. Alternatively, the event of interest may refer to a loss, a game ending, sub-events in a game such as the receipt of a new card in a video poker game, a power shutdown for the gaming machine or casino, an incident in a bonus game (e.g., a free spin of a video wheel), different stages or phases of a game, or some malfunction for the gaming machine that affects video output or processing in the gaming machine. In general, the event of interest may include any time, frame, event of video output, or historical moment in game play whose re-creation is desired. For example, hackers may unscrupulously penetrate a gaming machine and attempt to alter historical records of a rather innocuous game incidence (and convert the instance into a win). In this case, video re-creation for the instance of interest may rely on parallel remote server storage of the video data to provide correct historical results. An event may refer to any result, intermediate event, outcome or experience in game play or during interaction between a gaming machine and person. Recordation of winning outcomes is particularly useful and required by many gaming regulatory bodies. The present invention is not limited as to why historical re-creation is desired.

Figure 1:
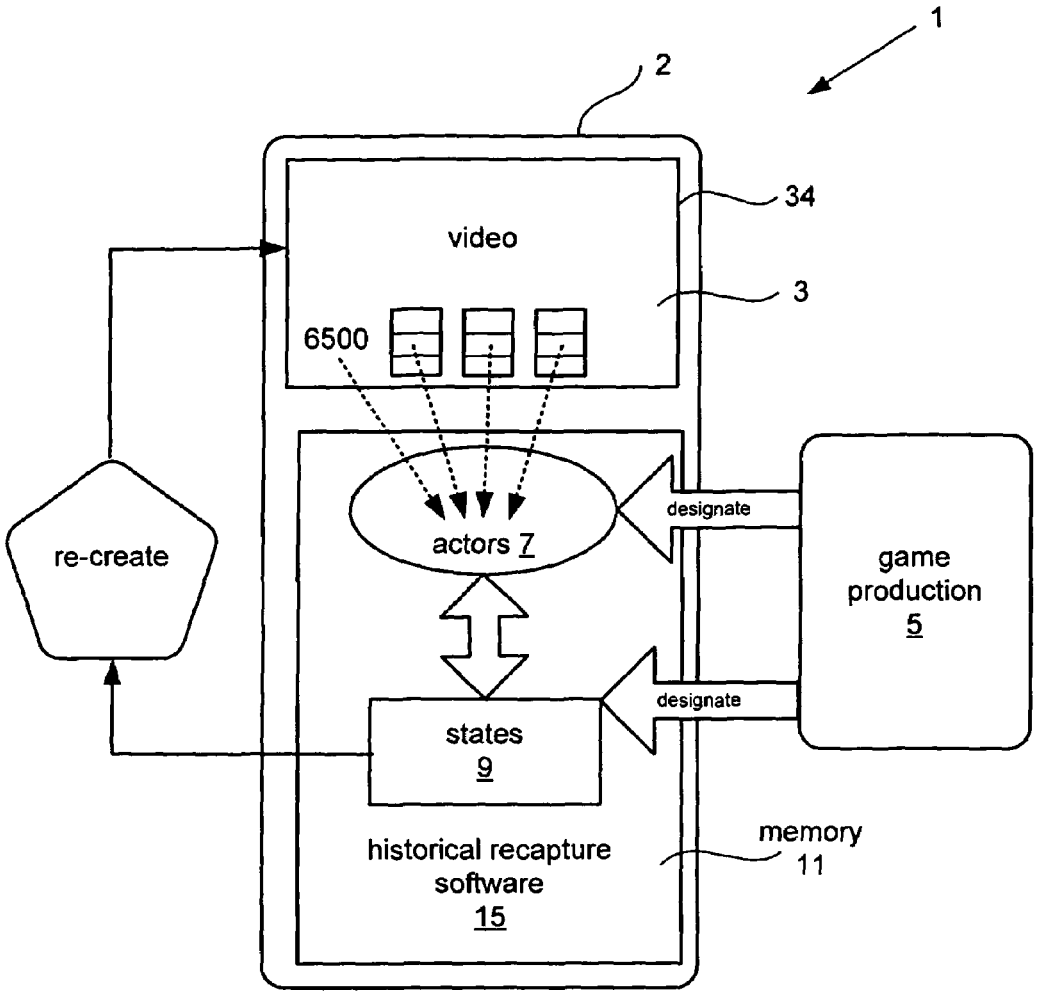
FIG. 1 illustrates a high-level depiction of the multi-phase nature of the present invention.

FIG. 1 illustrates a high-level depiction of a multi-phase system 1 of the present invention. A gaming machine 2 includes historical re-creation software 15 that stores a subset of data included in video output 3 that is provided on a display device 34 included with the gaming machine 2. In one embodiment, historical re-creation software 15 stores a known subset of information that was determined during game design and production 5. This simplifies storage complexity by knowing what information is needed for re-creation, what information is not, and thus reduces memory demands by storing only data needed for subsequent re-creation. As will be described below, the stored data may rely on re-rendering of the data; similar to how it was rendered the first time it was displayed.

In addition to predetermining what video data is needed for re-creation, the present invention may also separate video data to decrease memory requirements when saving the data. For example, video data on the display may be separated into static video and time varying video. Static video data refers to data that does not change for frames in a scene; and may be saved as a pointer or reference to the static video data in memory. Exemplary static video may include an unchanging background, a game name, position of the game name, etc.

Dynamic video warrants time-sensitive storage protocol. In one embodiment, video output that varies with time is constructed, captured, stored and reconstructed according to predetermined design. The particular design used may vary and will depend on the video output format, display device, complexity (e.g., 2-D or 3-D), gaming machine system, desired storage complexity, game production design and scheme, and programming code used, for example.

In one embodiment, the present invention organizes time-varying video information into 'actor' and 'status' designations. An actor 7 refers to a graphics item for video output whose behavior and video presentation (position, rotation, scale, appearance, etc.) changes with time. Some examples include moving graphical objects, video presentation of an amount won, video presentation of a current credit, video presentation of game denomination, random numbers generated, video presentation of a game paytable, game specific graphics, game tracking information, video presentation of a date, video presentation of a time, etc. Some actors 7 vary over time with user input. User variable actors include an amount wagered, player tracking information, etc. An actor 7 may include a visually separable video object, such as each rotating wheel in a video slots game with three rotating wheels, or multiple pieces such as an animated character that is divided into body parts and each body part represents a separate actor.

A state 9 refers to data that characterizes video display of an actor at a specific time. Each state 9 stored in memory 11 thus describes the video presentation status of an actor 7, as displayed on a video device that output the game for a gaming machine, at a particular instance of interest. For example, if the position of an object such as a ball (an actor) moves in 2-D on the screen, the state describes its 2-D position at a given time. Since this may be done with simple x-y coordinates, the amount of memory required for video re-creation and redisplay then reduces from i) all video information on the current frame (prior art, e.g., a JPEG file) to ii) the sum of a) static information, b) the x-y coordinates of the ball (a simple string), c) state data for a current number of credits, and d) other time varying information characterized by actors and states in the video frame. This simple example alone reduces capacity for storing the data in memory 11 by orders of magnitude (e.g., from a JPEG for the frame to a few strings of data). As will be described below, video information on a screen may be quite complex, stored frequently, and the savings become even more pronounced when hundreds or thousands of individual saves are made for a game over the course of a day.

Together, assigning actor and state status to each time varying object in video for a game cumulatively permits the video information to be represented over time and stored at any particular instance at any time using only the state information. The video data may be sampled at a desired rate, at predetermined game events (such as each time a person receives a card in a video poker game) and in response to a winning outcome. In this manner, historical re-creation software 15 included with gaming machine 2 stores and references a state 9 for each actor 7 for one or more frames leading up to and including an incident of interest. The number of frame captures, and qualifying incidents, is a matter of design choice.

The exact state 9 that is stored will depend on the game, scene, actors 7 in the scene, and states permissible to each actor. For example, if video output for a game permits rotation of a ball at some later scene of a game, then state 9 for the ball 7 for this scene will include 1 or 2-D rotation information in addition to state data that describes its 2-D position in the frame at the given time. Game design and graphical output may vary widely, and in general, the present invention is not limited to any game, scene, actor, state or design thereof. In specific embodiments, video data may include a video slot game, a video keno game, a video poker game, a video pachinko game or a video black jack game. Any time varying video information in these games may be represented by actors and states and stored as described herein. Other games are suitable for use with the present invention.

When desired, states 9 for each actor 7 are stored to enable re-creation; and recalled from memory to permit video re-creation and historical display 13. The re-created video output may include one or more frames that resemble video output leading up to and/or when the winning outcome occurred. In one embodiment, the same rendering software used to initially construct the video data is used to historically re-construct the recaptured video data. In these instances, the re-created video 3 may be substantially identical to that when initially output, even though the amount of data saved is far less than the bit total for the original and re-created frame. Additional frames before the winning outcome may be stored, depending on game design, user preference and memory availability. Indeed, storing states for individual actors allows any particular instance of video output to be instantly created, and allows game designers to flexibly decide what frames are stored within a sequence.

Multiple winning outcome frames can be stored and indexed according to game type, machine number, time, outcome, player, etc. In one embodiment, a gaming machine transmits state data to a resource separate from the gaming machine for storage, such as a remote server that provides data backup for many gaming machines. This embodiment is described in further detail below and in FIG. 9. Indexing entries in a central or server database allows video information for any particular frame to be readily recalled using automated processes by any gaming machine or property that communicates with the server, e.g., any gaming machine in a casino, including those other than the original machine that output the video.

In one embodiment, historical video re-creation (and subsequent presentation) is planned and implemented during game creation and design. A historical re-creation phase of game design may then designate instructions such as: a) what actor, state and other predetermined video data is stored during each scene of a game; b) how the predetermined video data is used to re-create video; c) how and where the state data is stored and retrieved, etc.

Having discussed an overview of video re-creation according to the present invention, a gaming machine suitable for use with the present invention will now be expanded upon.

Figure 2:
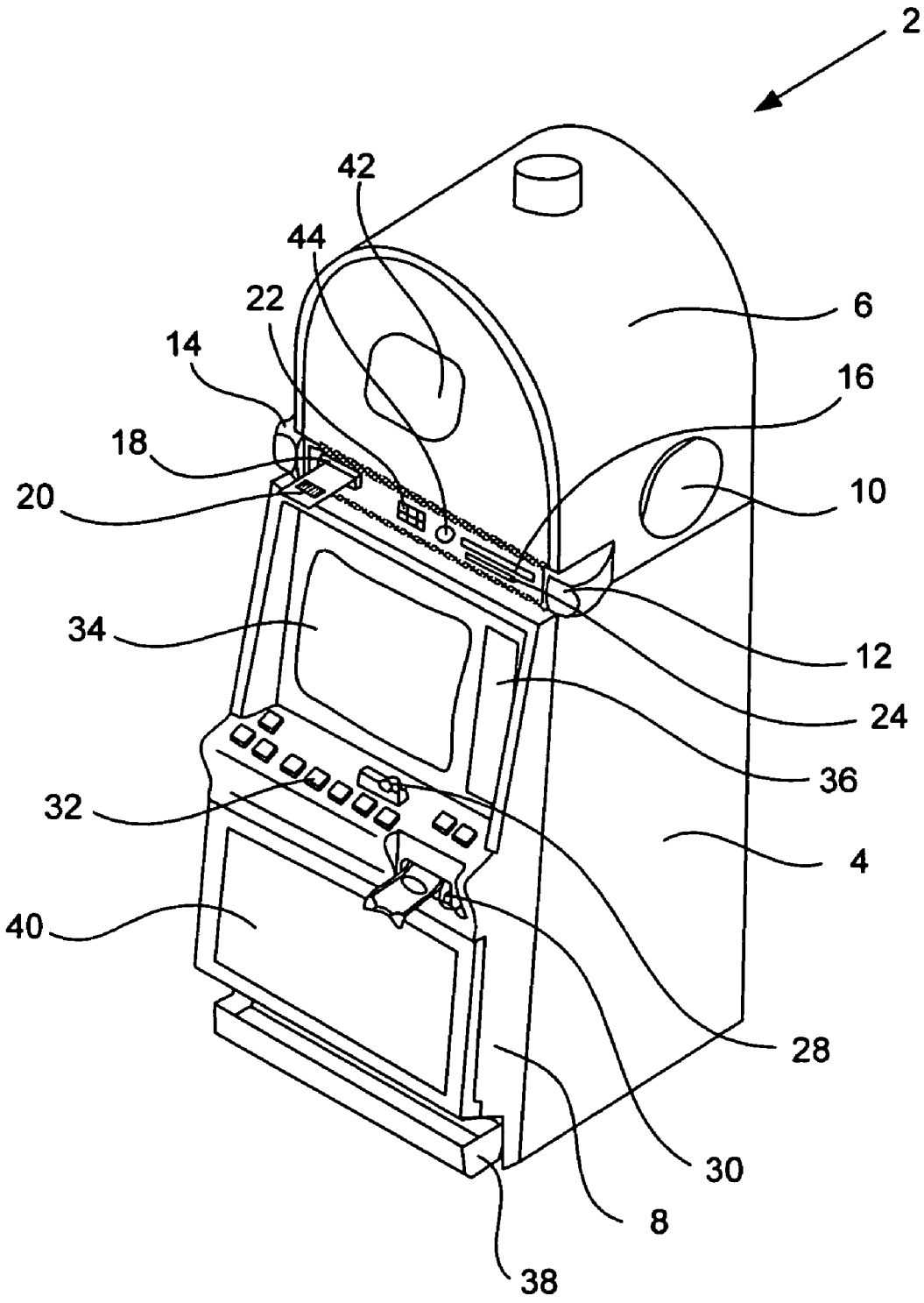
FIG. 2 is a perspective drawing of an exemplary gaming machine.

Turning first to FIG. 2, an exemplary video gaming machine 2 is shown. Machine 2 includes a main cabinet 4, which generally surrounds the machine interior (not shown) and is viewable by users. The main cabinet includes a main door 8 on the front of the machine, which opens to provide access to the interior of the machine. Attached to the main door are player-input switches or buttons 32, a coin acceptor 28, and a bill validator 30, a coin tray 38, and a belly glass 40.

Viewable through the main door is a video display device 34 and an information panel 36. The main display device 34 may include one of more of a cathode ray tube, flat-panel LCD, a transparent LCD, plasma/LED display, an OLED device or other conventional electronically controlled video display device.

The gaming machine 2 includes a top box 6, which sits on top of the main cabinet 4. A second display device 42 may be provided in the top box 6. The second display device may also include one of more of a cathode ray tube, flat-panel LCD, a transparent LCD, plasma/LED display, an OLED device or other conventional electronically controlled video display device.

Figure 3:
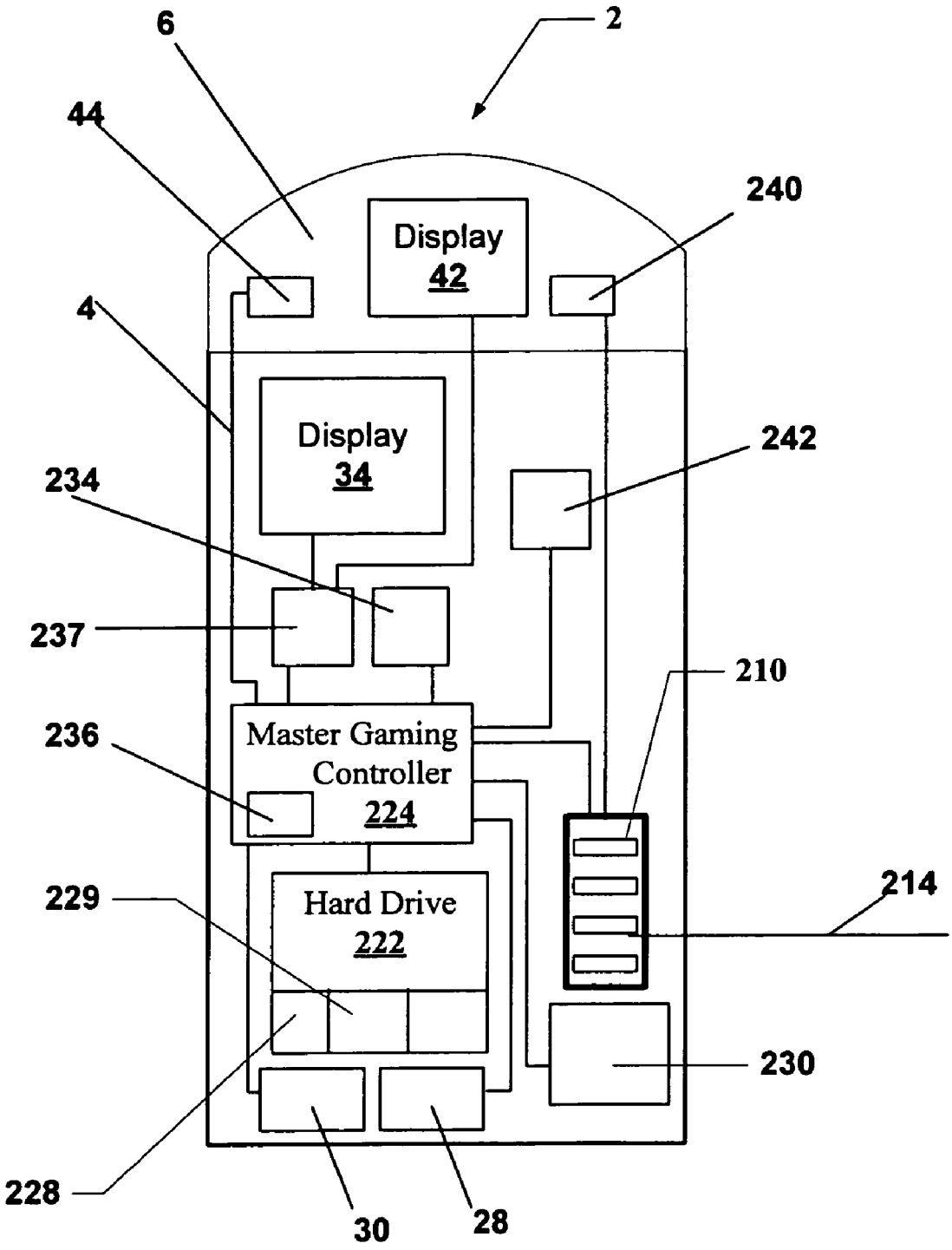
FIG. 3 is a block diagram of a gaming machine having a top box, two displays and other devices in accordance with one embodiment of the present invention.

Typically, after a player initiates a game on gaming machine 2, the main display device 34 and the second display device 42 visually display a game presentation, possibly including one or more bonus games, and controlled by a main processor 224 (see FIG. 3). The video component of game presentation may include a sequence of frames refreshed at a sufficient rate on at least one of the displays, 34 and/or 42, such that it appears as a continuous presentation to a player playing the game on gaming machine 2.

During game play and presentation, select video information (such as actor and state data) from one or more frames in a sequence for game presentation is captured and stored. In one embodiment, storage uses a memory device located on gaming machine 2. In another embodiment, storage uses a memory device located outside the gaming machine, such as memory operated by a remote server. Multiple storage locations can be used for redundant storage provision.

Information panel 36 may be a back-lit, silk screened glass panel with lettering to indicate general game information including, for example, the denomination of bills accepted by the gaming machine (e.g., $1, $20, and $100). Bill validator 30, player-input switches 32, video display device 34, and information panel are devices used to play a game on game machine 2. A main processor, housed inside main cabinet 4, controls these devices. During game play, information regarding the operation of one or more of these devices may be captured by gaming machine 2 as part of a game history on the gaming machine.

In the example shown in FIG. 2, top box 6 houses a number of devices, which may be used to input player tracking information or other player identification information into the gaming machine 2, including bill validator 30 which may read bar-coded tickets 20, key pad 22, fluorescent display 16, camera 44 and card reader 24 for entering a magnetic striped cards or smart cards. Camera 44 may be mounted in top box 6 and used to record images of a player playing a game on the gaming machine. Key pad 22, fluorescent display 16 and card reader 24 may be used to enter and display player tracking information. In addition, other input devices besides those described above may be used to enter player identification information including a finger print recording device or a retina scanner.

In addition to the devices described above, top box 6 may contain different or additional devices than those shown in the FIG. 2. For example, the top box may contain a bonus wheel or a back-lit silk screened panel which may be used to add bonus features to a game being played on gaming machine 2. During a game, these devices are controlled and powered, in part, by circuitry (not shown) housed within main cabinet 4.

Understand that gaming machine 2 is but one example from a wide range of gaming machine designs on which the present invention may be implemented. For example, not all suitable gaming machines have top boxes or player tracking features. Those of skill in the art will understand that the present invention, as described below, can be deployed on most any gaming machine now available or hereafter developed.

Returning to the example of FIG. 2, when a user selects a gaming machine 2, he or she inserts cash or credit through the coin acceptor 28 or bill validator 30. Bill validator may also accept a printed ticket voucher which may be accepted by the bill validator 30 as indicia of credit. Once the gaming machine has accepted cash or credit, game play may commence on the gaming machine. Typically, a player may use all or part of the cash entered or credit into the gaming machine to make a wager on game play. During the course of a game, a player may be required to make a number of decisions that affect the outcome of the game. For example, a player may vary his or her wager, select a prize, or make game-time decisions that affect game play. These choices may be selected using the player-input switches 32, a touchscreen associated with main video display screen 34 or using some other device which enables a player to input information into the gaming machine including a key pad, a touch screen, a mouse, a joy stick, a microphone and a track ball.

During certain game events, gaming machine 2 may display visual and auditory effects that can be perceived by a player. These effects add to entertainment and excitement of a game, which makes a player more likely to continue playing. Auditory effects include various sounds that are projected by the speakers 10, 12, 14. Visual effects include flashing lights, strobing lights or other patterns displayed from lights on the gaming machine 2 or from lights behind the belly glass 40. This type of information may or may be not captured as part of an archived game history, depending on design. After the player has completed a game, the player may receive game tokens from coin tray 38 or a ticket 20 from printer 18, which may be used for further games or to redeem a prize. Further, a player may receive a ticket 20 for food, merchandise, or games from printer 18. This information may also be incorporated into game history information or saved in a textual record of game history.

Many possible games, including video slot games, video poker, video pachinko, video black jack and video keno, may be provided with gaming machines of this invention. In general, the invention may be applied to any type of video game implemented on a gaming machine supporting video game presentations. Some gaming machines may provide multi-game capabilities where more than one type of game may be played on the gaming machine. For instance on the gaming machine 2, a player may select video black jack using the input buttons 32, make a wager, initiate a game and view a video blackjack presentation on the display screen 34 and then select a video slot game, make a wager, initiate a game and view a video slot presentation.

FIG. 3 is a block diagram of a gaming machine having a top box, two displays and other devices in accordance with one embodiment of the present invention. Features that appear in both FIG. 2 and FIG. 3 are identified by common reference numerals. A main processor 224 controls the operation of the various gaming devices and the game presentation on the gaming machine 2. Using a game code and graphic libraries stored on the gaming machine 2, the main processor 224 generates a game presentation which is presented on the displays 34 and 42.

The game presentation typically includes a sequence of frames updated at a rate of up to 75 Hz (75 frames/sec). For instance, for a video slot game, the game presentation may include a sequence of frames of slot reels with a number of symbols in different positions. When the sequence of frames is presented, the slot reels appear to be spinning to a player playing a game on the gaming machine. The final game presentation frames in the sequence of the game presentation frames are the final position of the reels. Based upon the final position of the reels on the video display 34, a player is able to visually determine the outcome of the game. For historical capture, states for actors in the video data may be stored for any frame(s) in the sequence, and typically include the last frame.

States for each actor in a frame of video data are temporarily stored in a memory 236 located on the main processor 224 or alternatively on video controller 237. The gaming machine 2 may also include a video card (not shown) with a separate memory and processor for performing graphic functions. Typically, memory 236 includes one or more buffers that store state data that is sent by the main processor 224 or video controller 237 to the display 34 or the display 42. The video memory and video controller may be incorporated into a video card which is connected to the processor board containing the main processor 224. The buffer may consist of RAM, VRAM, SRAM, SDRAM, MRAM, etc.

During game presentation, main processor 224 may preserve state data for various frames for game history purposes. These decisions are made in accordance with historical game code executed by controller 224. Typically, state data for one or more frames desired for game history presentation are captured. For instance, in a video slot game presentation, state data related to the final position of the reels is captured and saved. In a video blackjack game, main processor 224 may preserve: state data related to the initial cards of a player and dealer, state data related to intermediate hands, and a state data related to the final hands of the player and dealer.

After state data is captured from a frame buffer, the main processor copies the state data to one or more memory devices on the gaming machine such as the non-volatile memory 234, the hard drive 222 or other non-volatile mass storage for archival purposes. During the capture process, the state data may be stored in an intermediate memory location on the gaming machine before it is copied to the archival storage location. While in the intermediate memory, main processor 224 may operate on the captured state data. For instance, the state data may be coded into shorter words to reduce storage requirements. The intermediate memory location may be a portion of the non-volatile memory or the system RAM. The non-volatile memory device may include battery-backed random access memory devices and flash memory devices. On the hard drive 222, the game history state data may be stored in a history database partition 229.

In one embodiment, state data may also be stored and archived in locations outside of a gaming machine. In such embodiments, the gaming machine 2 transmits the state data to the outside location via a main communication board 210 and a communication connection 214 using an appropriate communication protocol stored on the gaming machine. Details of game history frame usage outside of the gaming machine are described with reference to FIG. 9.

During game play, the gaming machine may receive inputs from various devices installed within the main cabinet 4 and top box 6, including a card reader 240, a ticket acceptor 242, the bill validator 30, the coin acceptor 28 and the camera 44. The main processor 224 may incorporate information received from these devices into the game history as state data. In addition, main processor 224 may store the state data for the game history information in one or more storage devices. As an example, prior to initiating a video slot game, the amount of money accepted from a bill validator or the ticket value/number for a ticket accepted by the ticket acceptor may be stored as state data for actors defined for i) the amount of money accepted from a bill validator or ii) the ticket value/number for a ticket accepted by the ticket acceptor. In addition, this information may also be stored separately from state data for video data and actors related to a video game. This information may be stored as simple text for instance. As another example, an image recorded by camera 44 of a player playing the video slot game at the time when the outcome of the video slot game is presented on display 34 may be associated with a number of a person assigned in a player tracking environment, and state data for the person is recorded using the player tracking number (actor=image of or data regarding a person playing the game, state=a specific person's player tracking number). Subsequently, upon recreating of the video data, the player tracking number may be recalled, associated with the stored picture, and used to verify that the person claiming a discrepancy for a winning outcome is the same as the person who played the game during the winning outcome at dispute.

In general, any information input into a gaming machine, output from the gaming machine or generated by the gaming machine in the process of a game presentation may be represented by an actor and a state for the actor. The actors and states are usually predetermined via game code executed by the gaming machine. The exact set of actors and states will vary based on the game, gaming machine, gaming regulation rules, and user preferences (e.g., of a casino and what information they want to store). A standard set of information may be recorded into the game history for most games. Such a standard set may include "critical data" such as the amount wagered on the game, the credits on the machine at the recorded instance, the amount of award, the amount of loss, the time, the date and the type of game. In addition, information incorporated into the game history using actors and states may vary according to the outcome of a game or other events occurring on a gaming machine as related to game play on the machine. For example, when the player is awarded a jackpot above a certain amount, a name and a picture of the player playing the gaming on the gaming machine may be recorded.

The present invention may store states and video data at various instances in game play on a gaming machine. Generally, any frame or instance of video data may be preserved and reconstructed using actor and state definition and techniques described herein. In the past, only critical portions of a visual game presentation were re-created using game history information saved while the game was executed because of limited memory space. The present invention, however, permits more frames and instances to be preserved by greatly reducing data storage requirements for each save instance.

In one embodiment, the present invention preserves video data for "winning outcomes". A winning outcome refers to an event in a game played on a gaming machine in which cash or some other form of credit that measures player value increases. The credit may include the accrual of player tracking and loyalty points offered by gaming establishments such as casinos to reward frequent patronage. The winning outcome may occur in a regular game or a bonus game for example.

Figure 4:
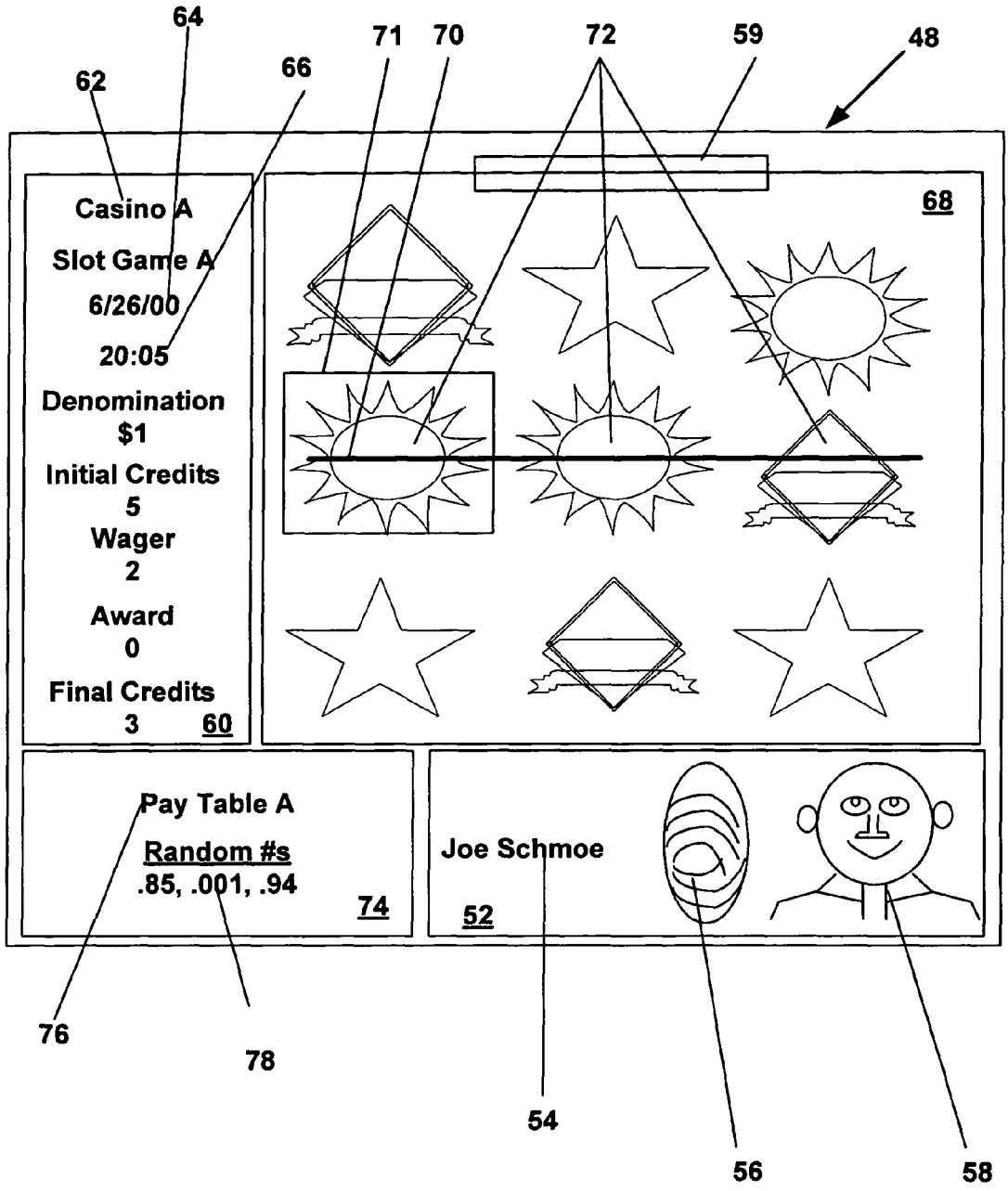
FIG. 4 illustrates exemplary 2-D static and time-varying video data included in a frame of video data.

FIG. 4 illustrates exemplary static and time-varying video data included in a two-dimensional (2-D) frame 48 that may be displayed on one of the displays, 34 and 42, of gaming machine 2. In the specific embodiment shown, game historical frame 48 includes video data in a game frame 68 that includes video data for a video slot game. Besides game presentation frame 68, historical frame 48 also includes game history information 60, game specific information 74 and player identification information 52.

Video data in frame 68 shows the final position of three "reels" for a video slot game including three symbols (e.g., 72) on a payline 70. From the displayed combination of symbols on payline 70, a player may visually determine an outcome of the video slot game, such as one or more winning outcomes offered by the game for various predetermined combinations of symbols.

In the specific embodiment shown, video data in frame 68 includes static video data and time varying video data. The static video data in game history frame 48 generally does not change and may include a name for the game, for example.

Actors for frame 48 include time-varying video that changes with game play and presentation. For example, payline actors 70 may change based on player wagering. In the example shown, only one horizontal payline 70 is in play (horizontal=a state for the first payline actor). More paylines may be used (an actor: the number of paylines). One method for increasing player interest and wagering is to present multiple paylines and games at the same time. For instance, a player may choose to play three paylines, or to play three hands of poker during each game presentation of triple play poker.

Symbols 72 change each time the player wagers and requests an outcome from the game. Each symbol 72 is an actor; and a state for each symbol 72 is selected randomly by the game each time a person wagers and plays. For most programmed games, each state includes a randomly determined number for the symbol amongst a set of possible numbers, as chosen by the game for a particular play. The numbers are predetermined and coded during game design. At the winning instance shown, the displayed states (a number as each state) are noted and stored for each actor.

Frame 48 may also include other actors such as date 64, time 66, pay table descriptor 76, pay table numbers 78, a player's name 54, the player's fingerprint 56, the player's picture 58, a banner message 59, over reels message (which may only show during a win), symbol overlay graphics (such as those used during a win), and symbol win indicators 71, etc. Within the video slot game itself, the actors include a line 70 and symbols 72.

Recreating frame 48 is then a process of recalling states for each actor at the time of frame 48 and rendering the video data using the states for each actor. This may be done with the same video and rendering software that produced the original display presentation. In this manner, archiving states for actors in frame 48 provides a historical record of the game outcome at frames 48 and 68 that may be produced solely by recalling the states from memory.

In addition, the states for each actor may be coded to reduce storage requirements. For the video data of FIG. 4, the coding may enumerate each of the possible symbols allowable in the video slot game (e.g., 011001 represents the "star", 011010 represents the "sun", etc.). The coding reduces storage requirements for each graphics item from the video data for each graphics item to the number used to identify each graphics item. Other coding techniques may be used, and in general, the present invention is not limited by any specific technique for enumerating individual states from a set or numbers used in coding.

For the game history frame 48 shown, game history information 60, game specific information 74 and player identification information 52 are rendered outside of game presentation frame 68. In other embodiments, parts or all of the game history information 60, game specific information 74 and the player identification information 52 may be rendered into game frame 68.

During game play, decisions made by a player may affect the outcome of a game and subsequent video output. Game history information representative of the player's game decisions may be captured by the gaming machine by states for various actors. For example, in a video poker game, a number of cards are "dealt" to the player, which appears as cards (an actor for each card and a state that identifies each card in this frame) on the video display screen representing the initial hand. Based on the dealt cards in the initial hand, a player decides to hold or discard certain cards using one of the input mechanisms on the gaming machine. The discarded cards are replaced by new cards (new states). Based on the decisions by a player, a series of hands may be displayed on the display screen to the player until a final hand is obtained. The final hand determines the game outcome and the award to the player.

Actors, states and video data may be saved and stored at each decision. As part of a game history, video data from frames representing an initial hand, intermediate hands (e.g., holds and discards) and final hand may be captured. For instance, states may be stored to permit reconstruction of a game history frames for: 1) a frame displaying an initial hand, 2) a frame displaying an intermediate hand, and/or 3) a frame displaying a final hand.

In one embodiment, states for all actors in frame 48 are saved. In another embodiment, states for a subset of actors in frame 48 are preserved for subsequent reconstruction of video data in frame 48. For example, only states of actors in game frame 68 may be saved. Alternatively, the personal information 52 may also be incorporated into historical capture. In general, historical video re-creation may include varying amounts of related information.

Each game history frame may also include additional video data—besides the changing game video data such as spinning wheels, cards and graphics—including game history information 60, game specific information 74 and player identification information 52. Game history actors and states may capture a location, a date, a time, an amount wagered, an amount won, player tracking information, an amount lost, random numbers generated to produce the cards, a game pay table, a game name, a game denomination (e.g., 5 cents, 25 cents, 1 dollar, etc.) and game specific information (e.g., cards held, cards discarded) and the like. In the game history frame 48 in box 74, game specific information including a "pay table A" 76 and random numbers generated corresponding to the symbols 72 are displayed.

Player identification information 52 is represented using one or more actors whose states are saved to allow subsequent rendering for historical playback. For instance, in FIG. 4, a player's name 54, finger print 56 and image 58 have been incorporated into the video data 48. The player's image may have been recorded with a camera 44 on gaming machine 2 (FIG. 2). The player's name 54 may have been obtained when a player entered player tracking information into the gaming machine 2 using the card reader 24. The player's name, fingerprint and picture may be stored on a main server and a state for any or all of these include a reference to the person, such as a numeric string, which consumes less memory.

In one embodiment, a gaming machine provides graphics and game presentations in one or more virtual 3-D gaming environments. In this case, two-dimensional images derived from a 3-D object in the 3-D gaming environment are rendered to one or more 2-D display screens on the gaming machine in real-time as part of game presentation. Nearly an unlimited variety of virtual objects and game atmospheres, such as slot reels, science fiction worlds, and entertaining games, may be modeled in a 3-D gaming environment.

Historically, due to the regulatory environment of the gaming industry, gaming software used to present a game of chance has been designed to "run in place" on an EPROM installed on the gaming machine. While ROM may store a program, it was not usually used for history data that changes with play; typically, some form of non-volatile memory was used in this regard. Using an EPROM, it was not generally feasible to store large amounts of game data relating to a complicated 3-D gaming model and environment. However, state and actor delineations as described herein permit 3-D environments to be stored and historically re-created from stored state data only, thus saving a large amount of video data relative to a all the video data used in a 3-D rendering. As will be described in further detail below, game design then includes a phase of historical re-creation production in which states for each phase are identified for subsequent recapture.

In addition, 2-D games rendered from 3-D environments on gaming machines have also become more sophisticated and often now offer complex animations and movies. Relative to playing 2-D movies, a 3-D status and actor system as described herein can actually provide improved graphics but still save memory for historical game recapture relative to movies and other memory intensive video.

Before discussing sample actors and states in exemplary 3-D rendered games, a brief description of 3-D rendering and game presentation will first be provided. Further detail on 3-D rendering and graphics presentation on a gaming machine is provided in commonly owned U.S. Pat. No. 6,887,157 and entitled "VIRTUAL CAMERAS AND 3-D GAMING ENVIRONMENTS IN A GAMING MACHINE", which is incorporated by reference herein for all purposes.

Figure 5A:
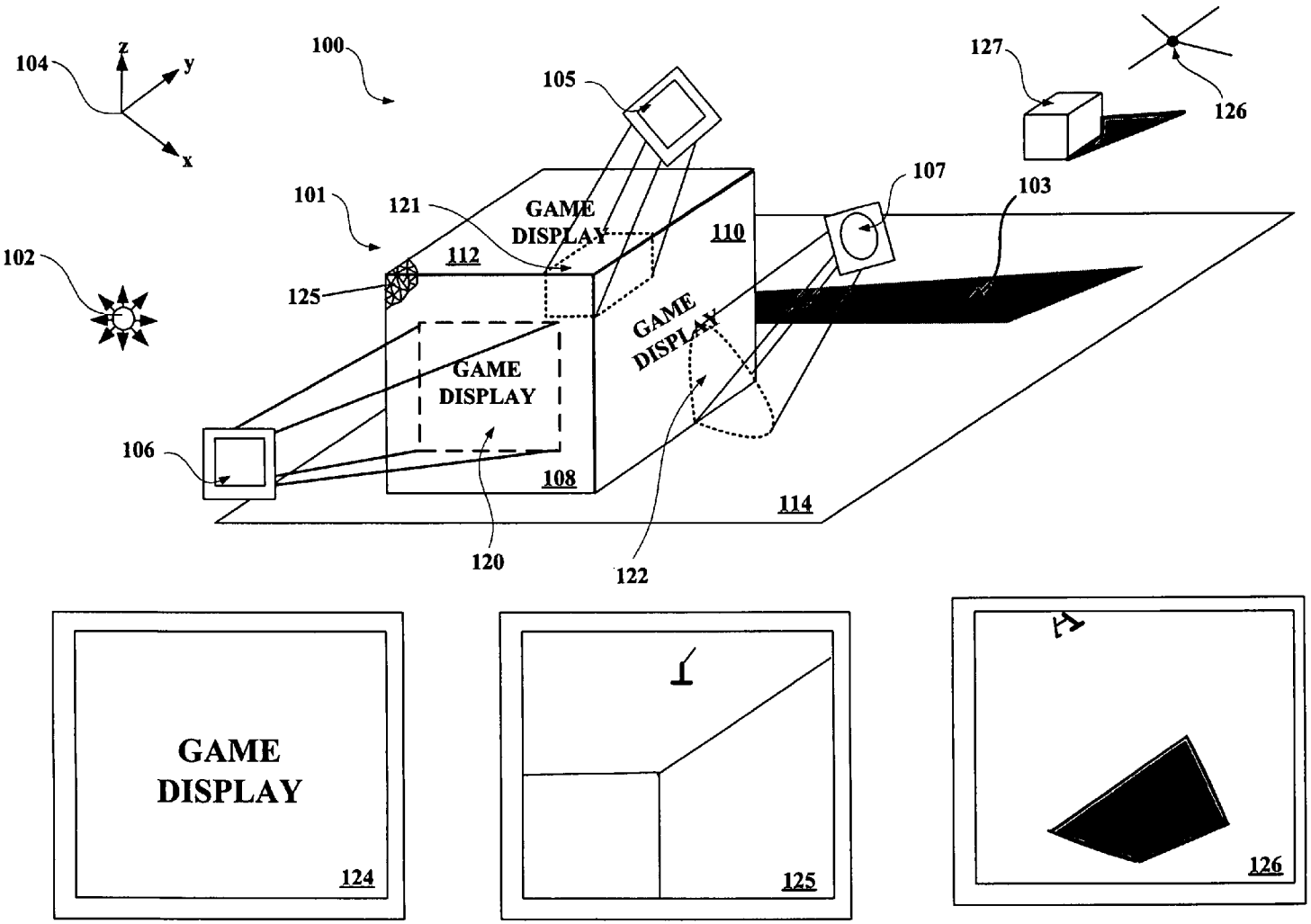
FIG. 5A provides a perspective drawing of an exemplary 3-D virtual gaming environment implemented on a gaming machine.

FIG. 5A provides a perspective drawing of an exemplary 3-D virtual gaming environment 100 implemented on a gaming machine. The 3-D virtual gaming environment may be used by a processor on gaming machine 2 to present a game of chance. The present invention will now be described with respect to a specific format and method for rendering 3-D gaming environments on a 2-D display; other 3-D rendering techniques are suitable for use with the claimed invention.

A 2-D view of a virtual 3-D gaming environment renders the virtual 3-D gaming environment. The 2-D view thus captures some portion of surfaces modeled in the virtual 3-D gaming environment. The captured surfaces in 2-D view are defined in 3-D coordinates of the virtual 3-D gaming environment and converted to a 2-dimensional coordinate system during the rendering process.

The 2-D view is generated from a viewpoint within the virtual 3-D gaming environment. The viewpoint determines what surfaces of a 3-D gaming environment defining a 3-D object are captured in a 2-D view. The viewpoint may be altered to generate different 2-D views of graphics items within the 3-D gaming environment. For instance, in one frame, a 2-D view of an object modeled in the 3-D gaming environment, such as a front side of a building (e.g., the viewpoint captures the front side of a building), may be generated using a first viewpoint. In another frame, a 2-D view of the same object may be generated from another viewpoint (e.g., the backside of the building).

The viewpoint represents an actor whose state is recorded for historical game re-creation as described herein. In some cases, historical re-creation may also permit rendering from additional viewpoints not originally presented, e.g., for further visual proof. Since states for a 3-D gaming environment are stored via states for each of the 3-D actors, a new viewpoint may be used when the game is re-created to generate new 2-D views of graphics items within the 3-D gaming environment. Since the state data has been saved to permit alternative viewpoints to be generated during historical game re-creation, the present invention provides an advantage over frame-based re-creation in that multiple viewpoints of a 3-D environment may be used during dispute resolution.

In another embodiment, when only 2-D information about a 3-D object is available, it is not possible to generate new 2-D views during historical re-creation from different viewpoints of the 3-D object. For instance, when a picture of a playing card is rendered on current gaming machines, 3-D information, such as the thickness of the card is not stored. Thus, it is not possible to generate a 2-D view of the playing card from an edge-on viewpoint, because the thickness of the card is not known.

One advantage of 3-D graphics environments is the potential game playing area used to present a game of chance modeled in a 3-D gaming environment is greater than the potential game playing area of a 2-D gaming environment. For instance, a game of chance may be presented on each of the six sides of a cube modeled in a virtual gaming environment. To play a game, 2-D views of the cube from different viewpoints in the 3-D gaming environment may be rendered in real-time and presented to the player.

Historical re-creation as described herein may maintain the flexibility to view from one side or any side of the cube by re-rendering the video data from the view used during initial game presentation (and potentially an additional view). Depending on game design, the cube may be initially rendered as a 2-D object generated from the 3-D cube as seen from a particular viewpoint. If the particular viewpoint was selected when the game is developed, then only 2-D information about the cube as viewed from the selected viewpoint will be stored to permit re-creation from that viewpoint.

Finally, in some 2-D gaming systems, due to the limited flexibility of 2-D, outcomes for a game of chance rendered in 2-D and displayed on a gaming machine may have to be quantified and pre-rendered, i.e., canned animations. Due to the flexibility of a 3-D gaming system, the outcomes can be determined through user input giving an unlimited number of animations in response to the players input. By not having to make a series of pre-canned animations but instead determining the animation in response to the players input saves many bytes in state storage space requirements.

Returning to FIG. 5A, the 3-D gaming environment 100 includes three objects: 1) a rectangular box 101 on top of, 2) a plane 114 and 3) a second box 126. The box 101, box 127 and plane 114 are defined in a 3-D rectangular coordinate space 104.

Typically, surfaces of the objects in a gaming environment are defined using a plurality of surface elements. The surface elements may comprise different shapes, such as different types of polygons that are well known in the 3-D graphical arts. For example, the objects in the present information may be defined in a manner to be compatible with one or more graphics standards such as Open Graphics Library (OpenGL). Information on OpenGL may be found at www.opengl.org. In one embodiment, graphics objects in gaming environment 100 are defined by a plurality of triangular elements. As an example, a plurality of triangular surface elements 125 define a portion of surface 108 and surface face 112 of box 101. In another embodiment, the objects in environment 100, such as box 101 and box 126, are defined by a plurality of rectangular elements. In yet another embodiment, a combination of different types of polygons, such as triangles and rectangles may be used to describe the different objects in environment 100. By using an appropriate number of surface elements objects may be made to look round, spherical, tubular or embody any number of combinations of curved surfaces.

Figure 5B:
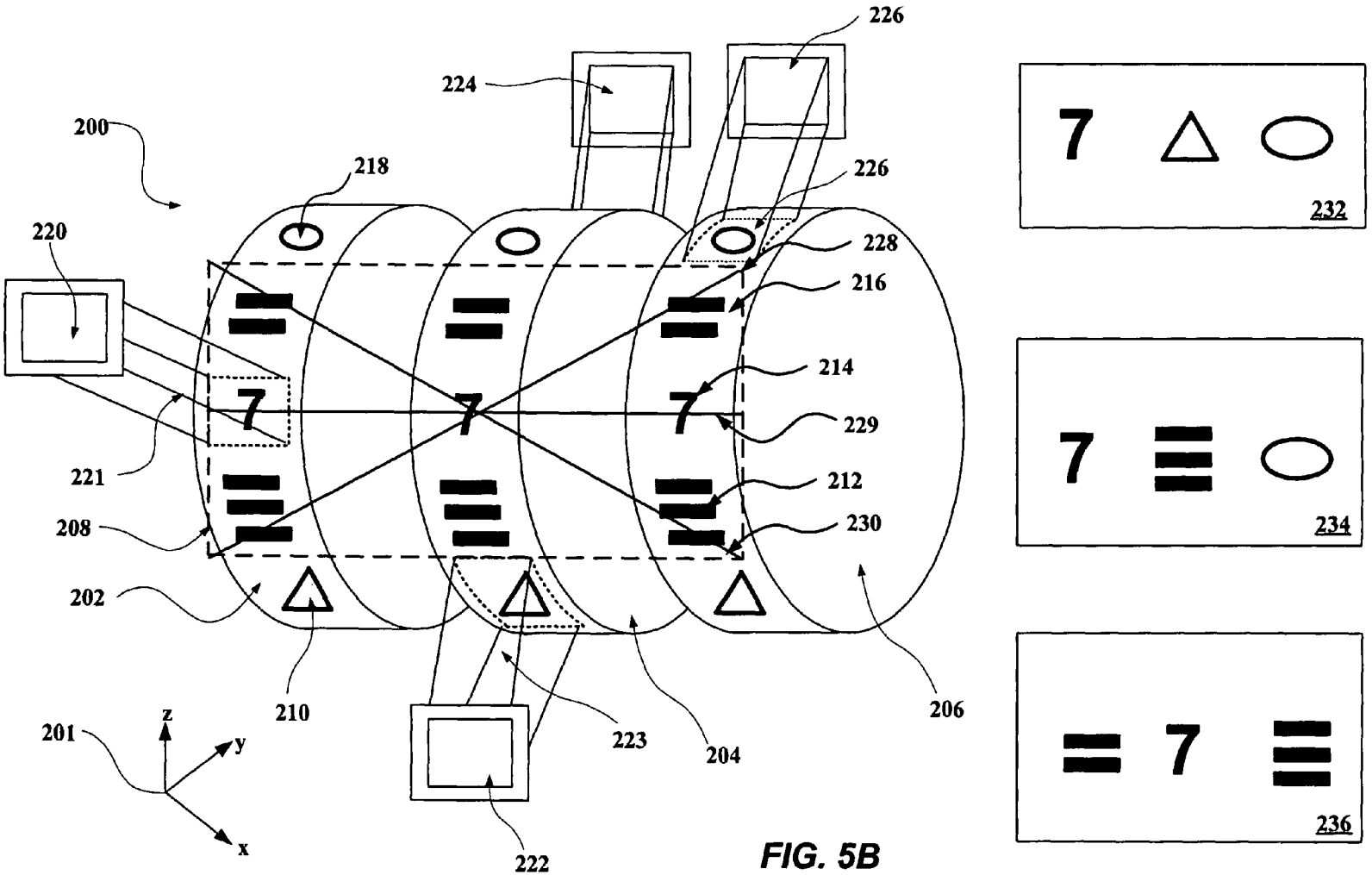
FIG. 5B is an illustrative diagram of a 3-D rendered game frame that may be displayed on a gaming machine.

Each surface element in the 3-D virtual gaming environment may be described in a rectangular coordinate system or another appropriate coordinate system, such as spherical coordinates or polar coordinates, as determined during game design. 3-D virtual gaming environments of the present invention are not limited to shapes and elements shown in FIGS. 5A and 5B or the coordinate system used in FIGS. 5A and 5B, which are shown for illustrative purposes only. Each of the surface elements may include one or more actors, such as actors that define the 3-D position, color or shading of each surface element. A state designates a current value for each surface element.

Surface textures may be applied to each of the surface elements, such as elements 125, defining the surfaces in the virtual gaming environment 100. The surface textures may allow the 3-D gaming environment to appear more "real" when it is viewed on a display screen on the gaming machine. As an example, colors, textures and reflectances may be applied to each of the surface elements defining the various objects in the 3-D gaming environment. Millions of different colors may be used to add a realistic "feel" to a given gaming environment. Textures that may be applied include smoothness or surface irregularities such as bumps, craters, lines, bump maps, light maps, reflectance maps and refractance maps or other patterns that may be rendered on each element. The textures may be applied as mathematical models stored as "texture maps" on the gaming machine. The surface texture for each surface element may also be represented by an actor, and a current value for each surface texture designated by a state. The surface texture states may be coded or enumerated to reduce storage capacity.

Material properties of a 3-D surface describe how the surface reacts to light. These surface properties may include such things as a) a material's ability to absorb different wavelengths of light, b) a material's ability to reflect different wavelengths (reflectance), c) a material's ability to emit certain wavelengths of light such as the tail lights on a car, and d) a material's ability to transmit certain wavelengths of light. Depending on the reflectance of a surface element, other items in the gaming environment may be reflected fuzzily, sharply or not at all. Combinations of color, texture and reflectance may be used to impart an illusion of a particular quality to an object, such as hard, soft, warm or cold. Again, material properties of a 3-D surface for each surface element may be represented by an actor, and a current value for each material property designated by a state (that may or may not be subsequently coded).

Shading methods are used with 3-D graphics to add texture. Gourand and phong shading are methods used to hide an object's limited geometry by interpolating between two surfaces with different normals. Further, using Alpha Blending, pixels may be blended together to make an object appear transparent i.e. the object transmits light. Shading for an object may also be represented by an actor, and a current value for the shading designated by a state.

Virtual light sources, such as 102, are used in a 3-D environment to add the appearance of shading and shadows, which add weight and solidity to the rendering of virtual objects. For example, to add solidity to the rectangular box 101, light rays emitted from light source 102 are used to generate a shadow 103 around box 101. In one method, ray tracing is used to plot paths of imaginary light rays emitted from an imaginary light source such as 102. These light rays may impact and may reflect off various surfaces affecting the colors assigned to each surface element. In some gaming environments, multiple light sources may be used where the number of lights and the intensity of each light source change with time. For historical re-creation, each virtual light source or shadow may also be represented by an actor, and a value for the shading designated by a state for the virtual light source actor.

Perspective, which conveys an illusion of distance, is applied to gaming environment 100 by defining a vanishing point 126. Perspective also allows objects in the gaming environment appear behind one another. Typically, a single point perspective is used where all of the objects in the scene are rendered to appear as though they will eventually converge at a single point in the distance—the vanishing point. However, multiple point perspectives may also be employed. For instance, box 101 and box 127 may be the same size. However, box 127 is made to appear smaller, and hence farther away, to a viewer because it is closer to the vanishing point 126. A 3-D gaming environment may or may not provide perspective correction. Perspective correction is accomplished by transforming points towards the center of the 2-D view screen. The farther away an object is from the viewpoint in 3-D gaming environment, the more it will be transformed into the center of screen. Again, for historical re-creation of the 3-D environment, position of each vanishing point may also be represented by an actor, and a value for the position designated at any instance by a state for the vanishing point.

Graphics presentation as described herein is not limited to perspective views or multiple perspective views in a 3-D gaming environment. An orthographic view may be used where 3-D objects rendered in a 2-D view always appear the same size no matter how far away they are in the 3-D gaming environment. The orthographic view is what one would see as a shadow cast from a light source that is infinitely far away (so that the light rays are parallel), while the perspective view comes from a light source that are finitely far away, so that the light rays are diverging. Combinations of both perspective and orthographic views may be used. If used, one or actors may represent variables used to construct an orthographic view, with states for each variable representing current values in a given video frame.

Related to perspective is "depth of field", which describes an effect where objects that appear closer to a viewer are more in focus and objects that are farther away appear out of focus. Depth of field may be applied to renderings of the various objects in gaming environment 100. Another effect that may be applied to renderings of objects in the gaming environment is "anti-aliasing". Anti-aliasing makes lines which are digitally generated as a number of straight segments appear smoother when rendered on a display screen. Because a 2-D display only takes finite pixel positions, stair stepping occurs on any lines that are not straight up and down, straight across (left and right) or at 45 degrees on the display screen. Stair stepping produces a visually unappealing effect, thus, pixels are added to stair-stepped lines to make this effect less dramatic. Again, if used, one or actors may represent variables used to apply depth of field and/or anti-aliasing, with states for each variable representing current values in a given video frame.

Objects in gaming environment 101 may appear to be static or dynamic. For instance, coordinates of box 127 may change with time while the coordinates of box 101 and plane 114 remain fixed. Thus, when rendered on a display screen on a gaming machine, box 127 may appear to move in gaming environment 101 relative to box 101. Many dynamic effects are possible. For instance, box 127 may appear to rotate while remaining in a fixed position or may rotate while also translating to generate an effect of bouncing or tumbling. Further, in the gaming environment, objects may appear to collide with one another. For instance, box 127 may appear to collide with box 101 altering the trajectory of box 127 in the gaming environment. Many digital rendering effects may be applied to the gaming environment of the present invention. Each effect, if used, can be represented by an actor whose current value for a video frame is stored as a state. Whether each actor is used in the frame will depend on game creation and actor designation for that scene, as will be described in further detail below with respect to FIG. 6.

Standard alpha-numeric text and symbols may be applied to one or more surface elements in gaming environment 101 to display gaming information to a player. The alpha-numeric text and symbols may be applied to various surfaces in the gaming environment to generate a plurality of game displays that are used as part of game outcome presentations viewed on the gaming machine. For instance, game displays can be rendered on any of the six surface faces of box 101 or box 127 and a plurality of game displays may also be rendered on planar surface 114. Again, if such presentations are used, actors and states in that frame will capture the video data for subsequent re-creation of the 3-D gaming environment 101 as initially seen by the player.

Rendered text and symbols allow game outcome presentations to be generated for different games of chance. For instance, a card hand for a poker game or blackjack game may be rendered on each of the faces of box 101 such as surfaces 108, 110 and 112. In this case, each card is an actor, and another actor designated for the number of cards. As another example, keno numbers or bingo numbers may be rendered on different faces of boxes 101 and 127. Here, each keno or bingo number is an actor. Further, slot displays (see FIG. 5B) and pachinko displays for slot and pachinko game outcome presentations may be rendered on different faces of boxes 101 and 127.

The rendered text and symbols are not necessarily planar and may be rendered in multiple in dimensions of gaming environment 100. For example, rendered cards may have a finite thickness and/or raised symbols. The cards may be dealt by hands that are defined as 3-D object models in environment 100 and move as the cards are dealt. As another example, a slot display may be rendered as multidimensional reels with symbols (see FIG. 5A) that rotate in environment 100.

A game display for a game outcome presentation may be rendered on a particular surface and may change with time in response to various player inputs. For example, in a poker game, a player may discard and hold various cards while they are playing the game. Thus, the cards in the hand change as the game outcome is rendered in the 3-D gaming environment and some cards (e.g., discarded cards) may appear to leave the gaming environment. As another example, reels on a slot display rendered in the gaming environment may begin to spin in the gaming environment in response to a player pulling a lever or depressing an input button on the physical gaming machine.

Other game features and gaming information may be rendered in gaming environment 100. For example, bonus games, promotions, advertising and attraction graphics may also be rendered in a 3-D gaming environment. For instance, a casino's logo or a player's face may be rendered in the gaming environment. These additional game features may be integrated into a game outcome presentation on the gaming machine or other operational modes of the gaming machine.

In general, actors may be defined for any presentation variables in environment 100. In addition, it is understood that the number and type of actors in any give frame of video data may change based on a scene in a video game sequence that the frame belongs to. Software associated with historical playback maintains a list of actors in each scene and frame, and when a request for historical capture occurs, the software acquires states for each actor accordingly.

After the gaming environment is defined in three dimensions, to display a portion of the 3-D gaming environment on a display screen on a gaming machine, the main processor on the gaming machine generates a "photograph" of a portion of the gaming environment. The photograph is a 2-D rendering of a portion of the 3-D gaming environment. Transformations between 3-D coordinate systems and 2-D coordinate systems are well known in the graphical arts. The photograph may be taken from a virtual "camera" positioned at a location inside environment 100. The position is yet another actor whose state is stored for a given frame to help re-create video data at a particular instance, such as when a win occurs.

A "photograph" displayed on a display screen may also include a composite of multiple photographs. For instance, a composite photograph may be generated from portions of a first photograph generated using an orthographic view and portions of a second photograph generated using a perspective view. The portions of the photographs comprising the composite photograph may be placed on top of one another to provide "layered" effects, may be displayed in a side by side manner to produce a "collage" or combinations thereof.

Operating parameters of a virtual camera, such as its position at a particular time, are used to define a 3-D surface in the gaming environment, which is projected on to a 2-D surface to produce the photograph. The 3-D surface may comprise portions of a number of 3-D objects in environment 100. The 3-D surface may also be considered a 3-D object. Thus, a photograph is a 2-D image derived from 3-D coordinates of objects in the 3-D gaming environment. The virtual camera may represent gaming logic stored on the gaming machine necessary to render a portion of the 3-D gaming environment 100 to a 2-D image displayed on the gaming machine—both in real time and during historical re-creation. The photograph is converted into a video frame, comprising a number of pixels, viewable on a display screen for the gaming machine.

The transformation performed by a virtual camera allowing a portion of the virtual gaming environment to be viewed on a display screen is a function of a number of variables, each of which may be represented as an actor for historical capture. The size of lens in a virtual gaming environment, position of the lens, a virtual distance between the lens and the photograph, size of the photograph, perspective and a depth variable assigned to each object are some of the variables/actors that may be incorporated into a transformation by the virtual camera that renders a photograph of environment 100. Resolution of the display device on the gaming machine may limit the size of a photograph in the virtual camera. A "lens size" on the virtual camera defines a window into the virtual gaming environment. The window is sometimes referred to as a viewport. The size and position of the lens determines what portion of environment 100 the virtual camera views.

After the photograph has been generated, other effects, such as static and dynamic anti-aliasing, may be applied to the photograph to generate a frame displayed on a display device. Typically, mathematical and logical operations, which are encoded in gaming software logic for the game, necessary to perform a particular transformation and generate a video frame may be executed by video cards and graphics cards located on the gaming machine and specifically designed to perform these operations—for both initial game display and historical re-creation. The graphics cards usually include graphical processing units (GPUs). However, the transformation operations may also be performed by one or more general purpose CPUs located on the gaming machine or combinations of GPUs and CPUs.

For advanced 3-D graphics, the 2D/3D video graphics accelerators or coprocessors, often referred to as graphics processing units (GPUs), are located on or connected to the main processor and are used to perform graphical operations. Video cards are commonly employed in this regard. The graphical electronics may be incorporated directly onto the processor board (e.g., the main processor) of the gaming machine, and even tightly integrated within other very large scale integrated chip solutions. The integration methods are often cost saving measures commonly used to reduce the costs associated with mass production. For instance, video cards, such as the Vivid!XS from VideoLogic Systems (VideoLogic Systems is a division of Imagination Technologies Group plc, England) may used to perform the graphical operations described in the present invention. As another example, video cards from Nvidia Corporation (Santa Clara, Calif.) may be employed.

Returning to FIG. 5A, three lenses, 105, 106 and 107 used in a virtual camera are shown and positioned at three locations in environment 100. Each lens views a different portion of environment 100. The size and shape of each lens may vary, which changes the portion of the virtual gaming environment captured by the lens. For instance, lenses 105 and 106 are rectangular shaped while lens 107 is ovular shaped.

Lens 106 is positioned to view the "game display" for a game outcome presentation rendered on surface 108 of box 101. The portion of environment 100 captured by lens 106 is a six-sided shape 120. After applying an appropriate transformation, a photograph 124 of this portion of the virtual gaming environment 100 in volume 120 is generated by the virtual camera with lens 106.

Lens 105 of a virtual camera is positioned to view volume 121 in environment 100. The volume 121 intersects three faces, 108, 110 and 112, of box 101. After applying an appropriate 3-D/2-D transformation, a photograph 125 of the portion of the virtual gaming environment 101 in volume 121 is rendered by the virtual camera with lens 105.

Lens 107 is positioned to view volume 122 in environment 100. The ovular shape of the lens produces a rounded volume 122 similar to a light from a flashlight. The volume 122 intersects a portion of face 110 and a portion of plane 114 including a portion of shadow 103. After applying an appropriate transformation, a photograph 126 of the portion of the virtual gaming environment 101 in volume 122 is rendered by the virtual camera with lens 107.

Using actors and states for each of these lens positions and variable definitions allows photographs 124, 125 and/or 126 to be re-created and re-rendered using historical state data. As mentioned above, historical software for the game may use one or multiple lens positions, as desired.

A sequence of photographs generated from one or more virtual cameras in environment 101 may be used. The sequence of photographs may appear akin to movie or film where video changes with time. Typically, a refresh rate for a display screen on a gaming machine is on the order of 60 HZ or higher and new photographs from virtual cameras in the gaming environment may be generated as the game is played to match the refresh rate.

A sequence of photographs from one or more virtual cameras in environment 100 may be generated with a position and/or lens angle that varies with time (e.g., a camera pan). For instance, lens 106 may represent the position of a virtual camera at time, t1, lens 105 may represent the position of the virtual camera at time, t2, and lens 107 may represent the position of the virtual camera at time t3. Photographs generated at these three positions by the virtual camera may be incorporated into a sequence of photographs displayed on a display screen.

FIG. 5B is an exemplary diagram of a 3-D rendered video slot game frame that may be displayed on a gaming machine. Specifically, the video slot game shown includes perspective renderings of three virtual slot reels, 202, 204 and 206 in a 3-D virtual gaming environment 200. The three slot reels are modeled as cylinder portions in coordinate space 201, and appear to be hanging space. Different symbols are rendered on each reel including a triangle 210, a triple bar 212, a "seven" 214, double bar 216 and an oval 218. Other symbols (not shown) may be rendered; and symbols may be rendered on the backs of the reels (also not shown). In the virtual 3-D slot gaming environment 200, a size of the reels, a number of reels, a number of symbols on the reels and types of symbols on the reels may be varied and represented as actors. Also, background scenery (not shown) may be also varied in the environment.

A window 208 is rendered over reels, 202, 204 and 206, to illustrate a number of symbols that may be visible on a mechanical slot display. At most, nine symbols, e.g., the three double bars, three sevens and three triple bars may be viewed on the slot display. When multiple symbols are viewed by the player, the multiple symbols may be used to generate multiple paylines that may be wagered on during game play.

When reels on a gaming machine stop after a wager has been received and a game has been initiated, a combination of symbols along a payline may be compared to winning combinations of symbols to determine an award for the game. For instance, three paylines 228, 229 and 230 are shown. Three "sevens" symbols are along payline 229. A triple bar, a seven and a double bar are shown along paylines 228 and 230. Often, a triple seven combination is used as a winning combination on a slot game. The number of paylines increases the betting opportunities for a given game and multiple payline games are desired by some players. In some slot games, only a single line of symbols may be viewed, such as the three sevens, and a player may bet on only a single payline.

For game presentation, the slot reels 202, 204 and 206 each rotate and move in the virtual gaming environment 200. The reels may rotate in different directions, translate, rotate around different axis, shrink in size or grow in size as the reels are not limited by the constraints of mechanical slot reels. During the game outcome presentation, a virtual camera, which may vary its position as a function of time, may film a sequence (e.g., generate a number of photographs in a sequence) that are displayed on a display screen on the gaming machine and that capture the motion of the reels.

A number of virtual cameras may be positioned in environment 200 to capture one or more symbols on the reels. For instance, lens 220 of a virtual camera captures the "7" symbol on reel 202 in volume 221 of the virtual gaming environment 200. Lens 222 of a virtual camera captures the "triangle" symbol on reel 204 in volume 223 of the virtual gaming environment. Lens 224 of a virtual camera captures a "triple bar" symbol (not shown) on reel 204 of the virtual gaming environment. Finally, Lens 226 of a virtual camera captures the "oval" symbol on reel 206 in volume 226 of the virtual gaming environment. However, a single virtual camera may also by used to capture multiple symbols such as a line of symbols across multiple reels.

The symbols captured from the virtual cameras using lens 220, 222, 224 and 226 create several paylines for wagering.

For example, the symbols captured from lens 220, 222 and 226 are used to generate a first combination of symbols 232. The symbols captured from lens 220, 224 and 226 are used to generate a second combination of symbols 234. Finally, virtual cameras may be positioned along payline 230 to capture the combination of symbols 236. Any of these paylines may be wagered on during game play. While only three paylines are shown, the number of paylines that may be implemented is quite large. For instance, for three virtual reels with 25 symbols on each reel, 253 paylines may be employed.

In this case, actors for gaming environment 200 include the symbol in each position (including the back positions that are not currently visible), the number of paylines selected by a player for the current game, which paylines were selected, a wager for each payline, final camera position in the 3-D environment, any variables that characterize motion of the wheels, orientation, scale, position, material attribute, lighting state, and animation state.

States for the actors listed above will vary with outcome of a game. For the example shown, the symbol in each position is shown (and these may be coded or otherwise enumerated, e.g., 7 is 1, two bars is 2, three bars 3, etc.), the number of paylines (3), which paylines were selected (horizontal middle, diagonal down and diagonal up), a wager for each payline (e.g., $1 each), final camera position in the 3-D environment, random number results, and animation states.

Other graphics items may be set in design and not variable during changing video for the scene, such as the number of reels, a center position of each reel, dimensions of each reel, a number of symbols on the reels, a number of symbols that are visible for each reel, motion of each reel during game play (e.g., rotation speed, translation, shrinking, etc.), basic layout, position of buttons or non-animating or static video placement.

Figure 6A:
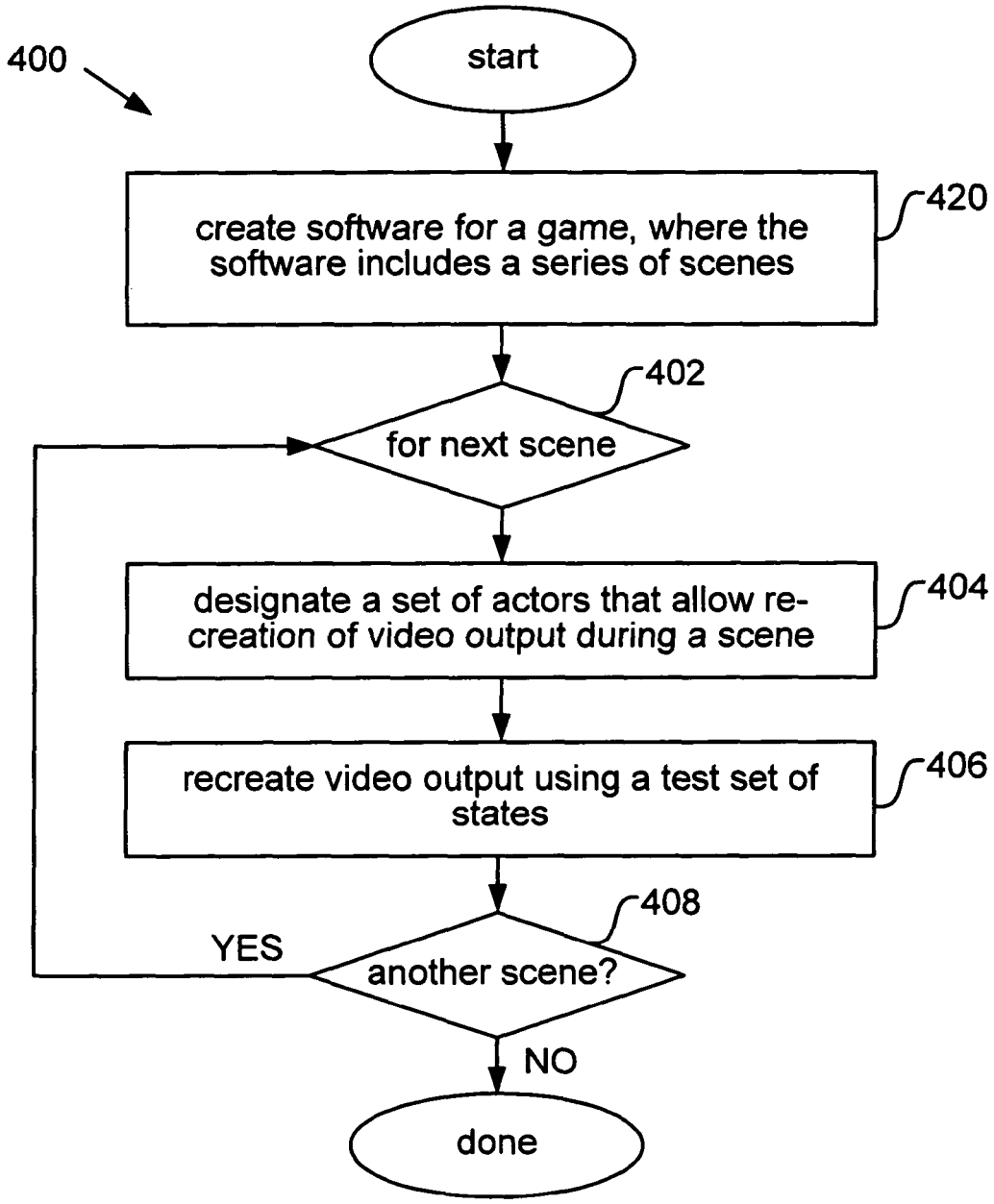
FIG. 6A illustrates a process flow for manufacturing a game playable on a gaming machine in accordance with one embodiment of the present invention.
Figure 6B:
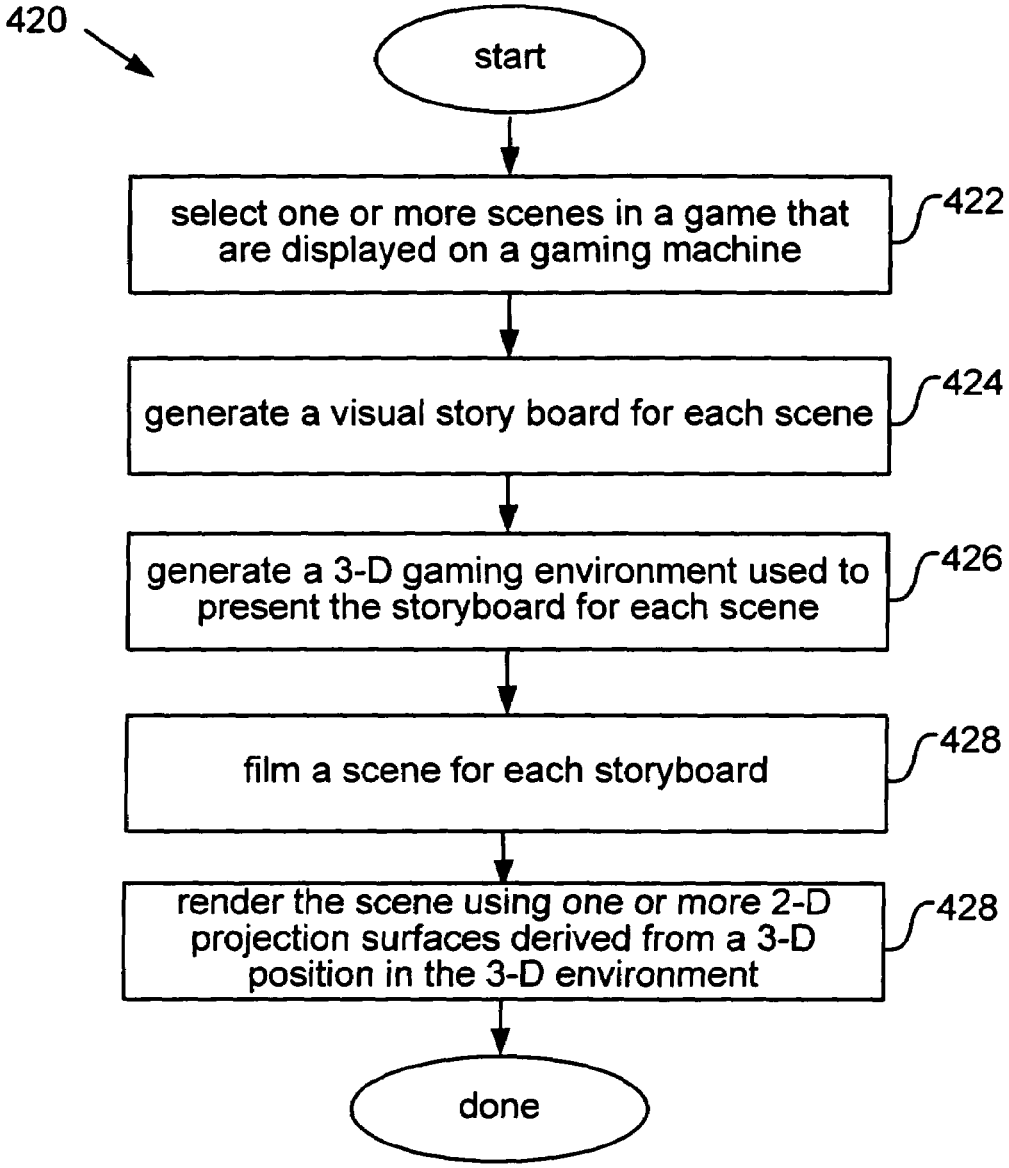
FIG. 6B shows a process flow for generating a game in a 3-D virtual gaming environment.

FIGS. 6A and 6B illustrate methods for manufacturing a game that includes historical re-creation and is playable on a gaming machine in accordance with one embodiment of the present invention. While the present invention will now be described with respect to specific actions during game design, those skilled in the art will recognize that other intermediate steps may be included but are omitted for sake of brevity.

FIG. 6A illustrates a process flow 400 for manufacturing a game playable on a gaming machine in accordance with one embodiment of the present invention. Process flow 400 begins by creating software for a game that allows a gaming machine to play the game (420, and FIG. 6B for a 3-D environment). The game includes a scheme comprising a series of scenes. The game scheme refers to a sequence of game scenes. An illustrative analog would be movie scenes (game scenes) in a movie story (a game sequence).

A game scene (also commonly referred to as a 'stage') refers to video output that includes a common set of actors. Recall that an actor refers to a graphics item for video output whose behavior and video presentation (position, appearance, etc.) changes with time in the scene. For example, a scene for a video slot game may include video data as shown in FIG. 4 or 5B. A scene for a video poker game may change each time a new card (an actor) is introduced. Once the video data or game changes such that new actors are needed to characterize the video data, then a new scene has been reached. Multiple video frames may occur in each scene, where video data in each frame may or may not change and states for each actor may or may not change. For example, the position and shading of a ball in a video pachinko game will vary over time (two actors) for frames of a single scene, but as long as only the position and shading changes, the scene remains the same. Introduction of a second ball (and one or more new actors for the new ball) may trigger a new scene for video pachinko. At each instance however, a state characterizes each actor in the scene, such as a specific x-y position of the ball and its specific shading.

Process flow 400 proceeds one scene at a time (403) for each scene in the sequence. For the next scene, a set of actors is designated that allow recreation of video output during any instance—such as a winning outcome—that occurs during the scene (404). Each actor relies on a state that describes the video presentation status of the actor at a particular instance, e.g., when a winning outcome occurs during game play. Thus, the state and actor combine to explicitly provide time-varying video data for a graphics item that characterizes the presentation status of the graphics item on a video device that output the game for the gaming machine.

This step also determines whether contents in a scene are not needed for re-creation, such as background components or static graphics that can be associated with the background according to scene design of the current scene, such as the green background of a video poker game and the title of the game on the green background. Instructions for recalling the scene then include recalls for fixed video data in the scene according to known positions in memory.

Historical game re-creation is also tested during game creation (406). Testing involves recreating the video output at a particular instance using the set of actors and a 'testing' state for each actor that corresponds to the video output for each actor at a particular testing instance. Testing in this manner occurs for each scene. As a result of this testing, actors may be redefined, states numbered for coding, software built to facilitate automated re-creation from stored and indexed database data, and so on, until instructions are produced that permit real-time re-creation of video data from a historical instance in time—using only the stored states and re-creation instructions stored in memory on a gaming machine or remote server.

The scene designation and testing steps (402 and 406) are then repeated for each scene in a game (407).

Coding logic may be applied to each actor and its states to reduce memory requirements in saving data for the actor. For example, enumerating cards in a video poker game from 1 to 52 provides short words for storing each card. Storage of state data for each card actor then only requires the enumerated card number (e.g., dealer card actor 'A'=0013, which may correspond to the king of hearts). Upon recreation, the enumerated state is then used as a pointer to video data graphics in memory for a particular card, instead of saving video data for the graphics of each card.

Historical game re-creation design may also apply a compression algorithm to reduce storage requirements of the data. Encryption or a signature may also be applied to increase security of the stored data and to prevent a fake game history frame from being used. In either case, the compression and/or encryption algorithm is stored with the historical game re-creation software but designed during game creation.

FIG. 6B shows a process flow 420 for generating a game in a 3-D virtual gaming environment. In 422, game scenes and events that form a game of chance are represented visually are selected. In 424, a 3-D visual storyboard describing a scene in a virtual gaming environment is generated for each game scene and event. The scene information may include virtual camera positions as a function of time in one or more gaming environments. For instance, a story board for cards being dealt in a card game may describe a pair of 3-D hands dealing the card over a gaming table with a virtual camera positioned directly above the gaming table looking down at the hands. In 710, a scene corresponding to the 3-D visual storyboard for each game event is generated in one or more 3-D virtual gaming environments. In 715, a scene corresponding to the visual storyboard for each game event is "filmed" in the one or more 3-D gaming environment. Filming each game event in the 3-D gaming environment comprises selecting a sequence of virtual camera positions and angles in the one or more 3-D gaming environments. In some embodiments, a player may control the position of the virtual camera in some manner. In 720, a sequence of 2-D projection surfaces (e.g., virtual camera images) derived from three-dimensional coordinates of surfaces in the 3-D gaming environment are rendered to a display screen on the gaming machine.

In the present invention, multiple "photographs" may be simultaneously generated from multiple virtual cameras located in one or more 3-D gaming environments on a gaming machine. The photographs are also commonly referred to as "screenshots" when they include a snapshot of video data on a screen. The photographs may be displayed on one or more display screens available on the gaming machine. In addition, virtual cameras may be located in virtual 3-D gaming environments located on remote gaming devices, such as remote servers or other gaming machines, in communication with the local gaming machine. For instance, a plurality of linked gaming machines may "share" a 3-D gaming environment and players on each of the plurality of gaming machines may be able to see activities of other players in the "shared" 3-D gaming environment and possible interact with other players in the shared 3-D gaming environment. For instance game players may be able to play games against other game players or play games with other game players. The gaming machines may be linked via a local area network, a wide area network, the Internet, private intranets and virtual private intranets.

A plurality of photographs from virtual cameras in one or more 3-D gaming environments may be arranged as a number of smaller game windows on a display screen on the gaming machine. For example, the display screen may be divided into four equally sized game windows. As another example, a smaller game window may be generated within a larger game window on the display screen like picture-in-picture on a Television. The multiple game windows may contain photographs generated from 3-D virtual gaming environments both local and remote to the gaming machine. In addition, the multiple game windows may contain information from other sources.

Figure 7:
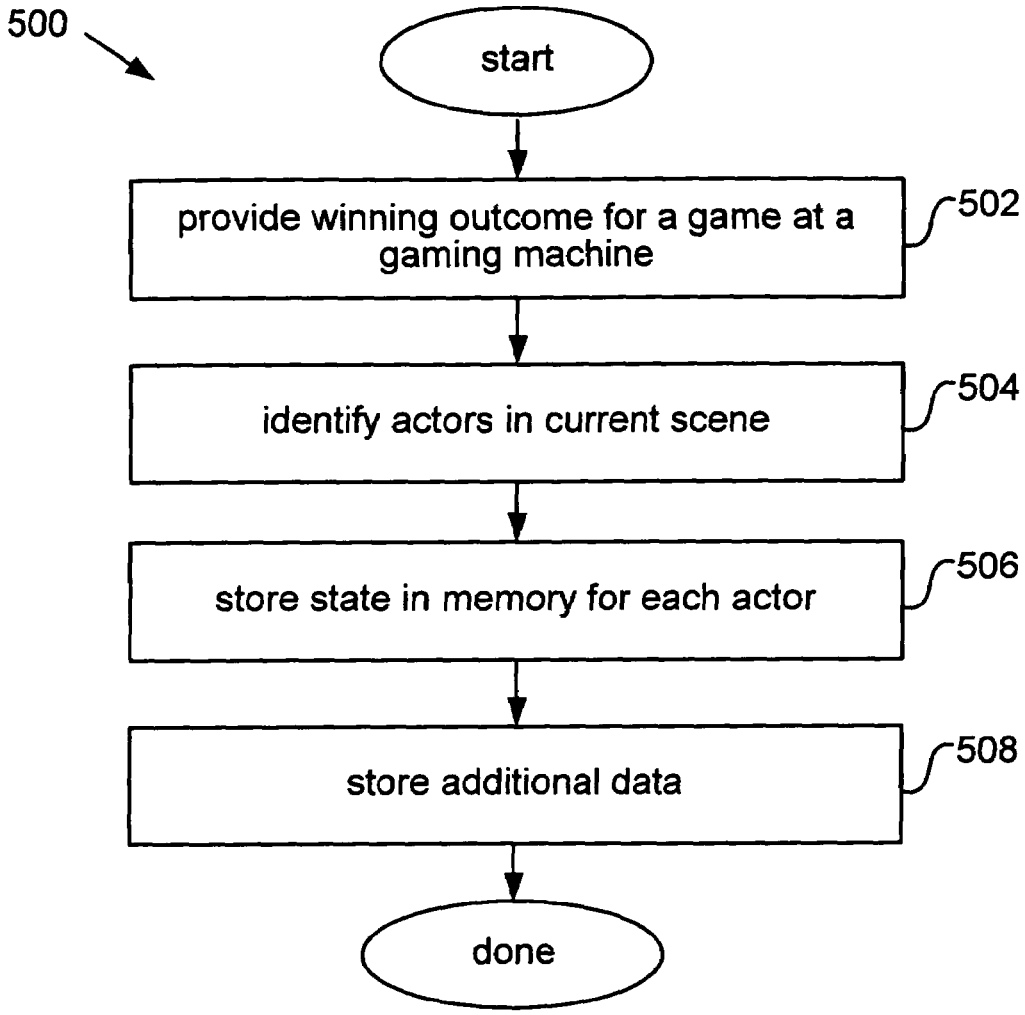
FIG. 7 first provides a process flow that stores data needed to re-create video output in accordance with one embodiment of the present invention.
Figure 8:
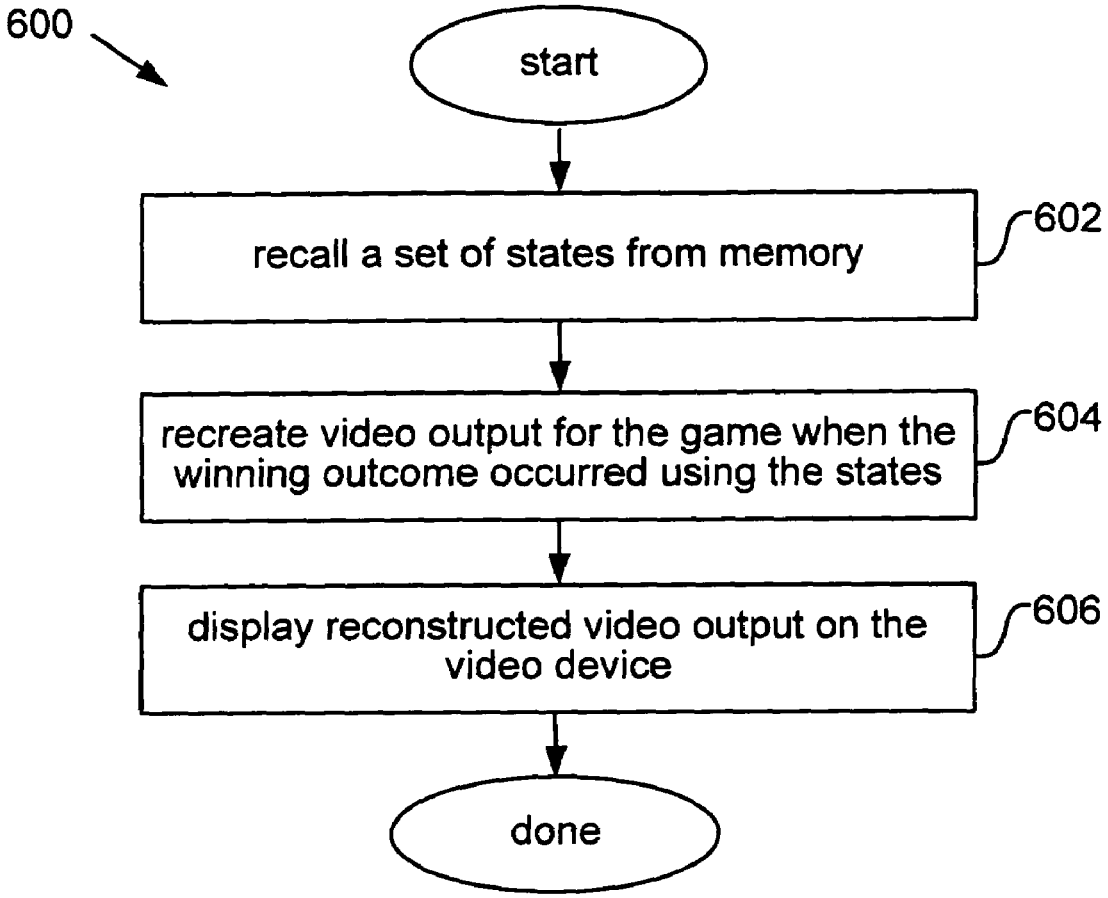
FIG. 8 then provides a process flow for recreating video output for a game using the stored data in accordance with one embodiment of the present invention.

FIGS. 7 and 8 collectively illustrate a method for recreating video output for a game played on a gaming machine in accordance with one embodiment of the present invention. FIG. 7 first provides a process flow 500 that stores data needed to re-create video output for the game in accordance with one embodiment of the present invention. FIG. 8 then provides a process flow 600 for recreating video output for a game played on a gaming machine using the stored data.

Process flow 500 may begin with a person entering a wager on a gaming machine and beginning game play. Over the course of a game, a player may be required to make a number of decisions that affect the outcome of the game. For example, a player may vary his or her wager, select a prize, or make game-time decisions that affect game play. In a pachinko game, the person may add balls into play. For a digital slots game, the player may pay more money to add multiple pay lines.

The gaming machine provides outcomes to the player. Outcomes may be generated by the gaming machine or by a central server that distributes outcomes from a centralized game pool to gaming machines in a network. Depending on how the game pool is configured, the gaming machine eventually provides a winning outcome to a player (502).

At some point in time, the main processor (or other processing mechanism) determines when game data is to be captured for historical storage. The determination may be based upon programming logic executed within the gaming machine or may be initiated from outside of the gaming machine.

At this time, the historical re-creation software identifies actors in the current scene (504) and stores the a) scene and b) a state for each actor in that scene (506). As mentioned above, each state describes the video presentation status of an actor displayed when the winning outcome occurred. In one embodiment, the historical re-creation software knows from game design (process flow 400) which actors are present in each scene and thus what states are needed for storage and re-creation at the current scene. The main processor then identifies the relevant data stored in a frame buffer and separates the data for storage.

If game history information, such as the amount bet, the amount won/lost, the time and the date, is not part of the video data in a main window, then the main processor may also capture additional state data for these actors as well (508). For example, the states may capture a time and date of the winning outcome.

The scene and state data may be saved in volatile memory and/or non-volatile memory on the gaming machine. In addition, the scene and state data may be transmitted to a remote server for archived storage at the server. The server archives the data to enable automated acquisition of the data at a later time. In a specific embodiment, this includes referencing the data by one or more of: a) the gaming machine where the win occurred, b) the time of day, c) the game, d) the scene when the event of interest occurred, e) casino or gaming establishment, e) personal identification for the winner such as that gained via player tracking information, and/or f) amount won. The data stored may also be stored an intermediate location, such as a portion of the non-volatile memory 222 in FIG. 2, before storage in non-volatile memory. Alternatively, the state data may be copied directly to the non-volatile storage device without intermediate storage or processing.

Compression, encryption or a signature may also be applied to the stored data. In a specific embodiment, the master gaming controlled generates a game history signature from the state data that allows the state data to be unambiguously identified. The signature permits automated verification of the authenticity of state data to determine whether the data has been corrupted. Exemplary algorithms suitable to generate a signature include checksum, hash value and CRC algorithms. A checksum algorithm sums values of bits comprising the state data to produce a number; the number becomes the stored signature. In a specific embodiment, the signature is appended to the game history data.

FIG. 8 illustrates a process flow 600 for recreating video output for a game played on a gaming machine in accordance with one embodiment of the present invention.

Game history playback is often used during a dispute resolution, e.g., between a person and a gaming establishment such as a casino. In one embodiment, a casino personnel engages a 'game history mode' on a gaming machine during the dispute resolution process. The game history mode finds use in other occasions such as when a gaming machine appears to be malfunctioning. The game history mode refers to an operation status for the gaming machine in which games are not playable but historical software stored on the gaming machine operates and game history data becomes accessible. Thus, while in game history mode, the state data and other game history information for one or more games may be retrieved. Via the game history mode software for this game, the main processor finds the appropriate historical data for the dispute at hand in a database, and determines whether the historical data is encrypted (or compressed). When the data is encrypted (or compressed), the main processor decrypts the data (or decompressed).

The gaming machine then recalls the winning scene and set of states corresponding to the scene from memory (602). As mentioned above, the memory may be local to the gaming machine or in a remote server. To increase re-creation confidence, the gaming machine may access both local memory and server memory and compare the data in each to add a layer of data integrity and verification in the event that one of the two has been corrupted or tampered with.

Alternatively, if a Checksum or other signature was used when storing the data, then the main processor validates the stored data by: a) calculating a new Checksum value from the state data, and b) comparing the new Checksum value with the stored Checksum value. When the signatures do not agree, the display device outputs an error message. When the signatures agree, then process flow 600 continues.

A graphics engine on the gaming machine then uses the recalled set of states to re-create video output for the game when the winning outcome occurred (604). For 3-D data, this includes rendering video using the stored state data and graphics routines for the game and current scene.

If the gaming machine recreating the video was the same as the gaming machine that originally presented the winning outcome, the historical re-creation software may use graphics routines for the game that are loaded on the gaming machine. If the gaming machine recreating the video is different or no longer offers the game, then the historical re-creation software may download or otherwise obtain any graphics routines needed to reconstruct the video data.

The reconstructed video output is then output to the person (606). This may occur on a main display for the gaming machine, or a sub-display such as that included in a top box.

Alternatively, the actors and states may also be output via textual output. For example, game history information such as the amount wagered, time of play, and gaming machine may be output using text. The textual presentation of game history information provides another presentation of game history that is simpler to implement and useful in game disputes in the event of video playback malfunctions or inabilities. Except when a game malfunction has occurred, the textual presentation and the graphical presentation should be consistent. For instance, an error in the game presentation code and/or a malfunction in the gaming machine hardware may produce an erroneous graphical game presentation which differs from the textual game history information stored in the gaming machine.

In one embodiment, a game history database stores the state data in a non-volatile memory on a gaming machine. In another embodiment, the game history database is transmitted to a remote server and stored in a memory on the server.

Figure 9:
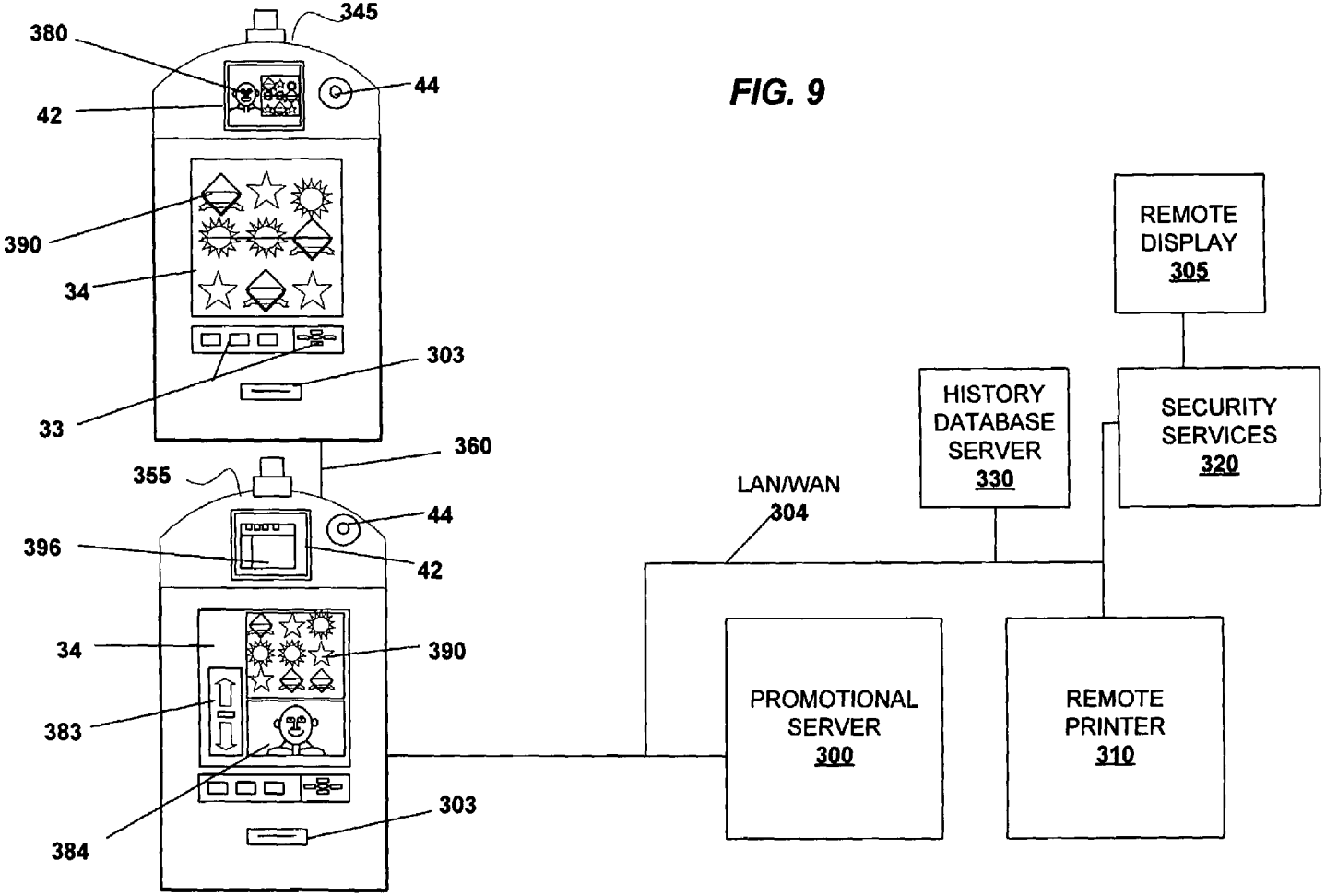
FIG. 9 is a block diagram of a gaming machine connected to a number of devices that may use captured game history information.

FIG. 9 is a block diagram of a gaming machine connected to a number of devices that may use captured game history information. Two gaming machines, 345 and 355, with features described with reference to FIGS. 2 and 3, are connected together in a gaming machine loop 360 and to a Local Area Network (LAN) or Wide Area Network (WAN) 304. On the network 304, a number of devices are connected to the network including a promotional server 300, a history database server 303, a remote display 305, security services 320 and a remote printer 310. These devices may use and process game history information generated on the gaming machines 345 and 355.

On gaming machine 345, video data for a game (current or historical) frame 390 is displayed on display 34. Video data in the top display 42 is a composite of a frame for game presentation 390 on a main display 34 and a picture of the player playing the game recorded with the camera 44. The video data for frame 390 or in top display 42 may be printed to printer 303 at the gaming machine. The video data for frame 390 or in top display 42 may also be transmitted from gaming machine 345 to promotional server 300 and/or remote printer 310. Remote printer 310 may print out a higher quality print than printer 303. Promotional server 300 may store and archive the state data for any defined actors for later applications. e.g., settling a dispute over winnings.

On gaming machine 355, game history information is displayed in the context of a resolution of a game dispute. In one game dispute resolution process, an attendant is called to a gaming machine. The attendant inserts a key in the side of the gaming machine that allows the gaming machine to be placed in a game history mode. In the game history mode, game history information relating to a number of past games played on the gaming machine may be recalled. For instance, the gaming machine may store state data that permits recreation of frames relating to the past 75-100 games played on the gaming machine in a game history database (e.g., history database in partition 229 of FIG. 3). The state data are applied to actors in the game to build a frame that is displayed to display screen 34 of gaming machine 355 using the history playback code. The history playback code may consist of software instructions necessary to recall the game history state data from the game history database, create one or more frames of video data using the state data, and display the historical frames to one of the gaming machine displays using the frame buffers and/or other video elements on gaming machine 355.

Game history information may also be stored in a history database on server 330 and accessed by the game history playback code in a gaming machine. As described above with reference to FIG. 3, when game history information including game history state data is stored in the non-volatile memory 234 of a gaming machine, it may be also be periodically transmitted to a history database server. This history database server 330 contains a copy of information stored on one or more gaming machines that may be used when data on the gaming machine has been lost or corrupted. In some embodiments, the history database server 330 is used instead of non-volatile memory on a gaming machine to store a game history database. A fast data transmission rate between the gaming machine (e.g., 355) and game history server 330 may be used to improve speed and performance of this system.

Game history information archived in this manner may be rendered and redisplayed at the gaming machine where it was generated or on another remote system. The remote system may be another gaming machine or a video display attached to a personal computer. For instance, if the video display failed on a gaming machine, a game history for the gaming machine could be displayed on an adjacent gaming machine or the video display attached to the personal computer by accessing game history server 330.

In another embodiment, archived game history information is used in a current game presentation, bonus game presentation and/or a bonus game scenario. For instance, when a player initiates game play on a particular gaming machine, game history server 330 recalls a record of game histories from previous games the player has played. Graphical information from previous games obtained from the game history server 330 is then incorporated into the game presentation of a current game being played.

In one specific game dispute resolution process, upper display screen 42 outputs textual game history information while main display 34 outputs rendered video data for the game. Touch screen controls 383 or input switches 33 allow a user to browse through reconstructed frames corresponding to state data stored on a gaming machine or archived in a remote database 330. As described above, the video data may correspond to different types of games. Thus, a first reconstructed frame may correspond to a video slot game while a second reconstructed frame corresponds to another video game such as video poker, video pachinko, video black jack or video keno. As shown on gaming machine 355, reconstructed frame 390 includes a picture of a player 384 that played the game at the time of data storage. The picture can be retrieved as it was captured by a camera or obtained via other player identification information such as player tracking information entered by a player.

During a game dispute resolution, game history frame 390 and game history data 396 may be transmitted to security services 320 and viewed on a remote display 305. After retrieving, rendering and viewing the historical video, the gaming machine typically is restored to a game playing mode.

Although the foregoing invention has been described in some detail for purposes of clarity of understanding, it will be apparent that certain changes and modifications may be practiced within the scope of the appended claims. Therefore, the present examples are to be considered as illustrative and not restrictive, and the invention is not to be limited to the details given herein, but may be modified within the scope of the appended claims.

What is claimed is:

1. A method for recreating video output for a game played on a gaming machine, the method comprising:

displaying the video output for the game during game play on a video device controlled by the gaming machine, the video output comprising a plurality of video frames;

in response to a first event of interest occurring in the game, storing first state data in memory for an actor displayed in a first video frame of the video output, wherein:

the first event of interest occurs during the game and prior to an outcome of the game, the first state data characterizes a position, a rotational orientation, and a scale for the actor, a presentation status of the actor in the first video frame is generated by applying the first state data to the actor, the first video frame includes data with a first amount of display memory bits, the first state data uses a first amount of state memory bits when stored in the memory, and the first amount of state memory bits is less than the first amount of display memory bits;

recalling the first state data for the actor from the memory;

forming re-created video output for the game by applying the first state to the actor, wherein the re-created video output is substantially identical to the video output in content; and displaying the re-created video output.

2. The method of claim 1 wherein:

the video output includes two-dimensional image data, the video device is substantially two-dimensional, and the two-dimensional image data depicts a three-dimensional graphics model of the game.

3. The method of claim 2, wherein the presentation status described by the first state data includes data that describes a three-dimensional actor in a three-dimensional environment model.

4. The method of claim 2, wherein a the two-dimensional image data depicts a perspective view or an orthographic view of the actor.

5. The method of claim 2, further comprising re-creating a surface texture used in the three-dimensional graphics model using texture data in the first state data.

6. The method of claim 2, wherein the video output depicts the actor moving over time with game play.

7. The method of claim 2, wherein the first state characterizes one of a three-dimensional position, a three-dimensional rotational orientation, and a three-dimensional scale for the actor.

8. The method of claim 2 wherein additional first state data is stored for each additional actor needed to re-create the video output.

9. The method of claim 1, wherein the video output depicts the actor moving over time with game play.

10. The method of claim 1, wherein additional first state data is stored for each additional actor needed to re-create the video output.

11. The method of claim 1, wherein the first state data for the actor is stored at the time the event of interest occurs.

12. The method of claim 1, wherein the memory includes non-volatile memory located in the gaming machine.

13. The method of claim 1, wherein the memory includes memory not located in the gaming machine.

14. The method of claim 13, further comprising transmitting the first state data from the gaming machine to a server that is remote from the gaming machine and configured to store the first state data.

15. The method of claim 14, further comprising transmitting the first state data from the server to the gaming machine when re-creating the video output.

16. The method of claim 13, wherein the first state data is indexed in the memory by using one of: a number identifying the game, a number identifying the gaming machine, and a time that the game was played.

17. The method of claim 1, wherein the first state data is recalled from the memory in response to a dispute regarding an outcome of the game.

18. The method of claim 1, wherein the game is selected from the group consisting of a slot game, a keno game, a poker game, a pachinko game, a video black jack game, a bingo game, a baccarat game, a roulette game, a dice game and a card game.

19. The method of claim 1, wherein the game is a bonus game.

20. The method of claim 1, further comprising storing a pointer, wherein the pointer indicates a memory location storing static video information included in the video output when the first event of interest occurred.

21. The method of claim 1, wherein the re-created video output is displayed on the same video device which was displaying the video output during the event of interest.

22. The method of claim 1, further comprising:

in response to a second event of interest occurring in the game, storing second state data in memory for the actor displayed in a second video frame of the video output, wherein:

a presentation status of the actor in the second video frame is generated by applying the second state data to the actor, the second video frame includes data with a second amount of display memory bits, the second state data uses a second amount of state memory bits when stored in the memory, the second amount of state memory bits is less than the second amount of display memory bits, and the second event of interest occurs during the same game play as the first event of interest; and recalling the second state data for the actor from the memory, wherein the forming re-created video output for the game further comprises applying the second state data to the actor.

23. A method for manufacturing a game playable on a gaming machine, the method comprising:

creating software configured to cause the gaming machine to offer the game for play, wherein the game comprises a series of scenes; and designating a set of actors for each scene, wherein each actor is defined to include parameters, each parameter characterizing a position, a rotational orientation, and a scale for the actor, wherein:

each parameter may be set to a value, application of the values of the parameters to that actor define a presentation status for that actor, the software is configured to save the values for the parameters for one or more actors in the set of actors as state data to a memory during play of the game in response to one or more events of interest occurring during play of the game, wherein the one or more events of interest occur during the game and prior to an outcome of the game, and the software is further configured to cause the gaming machine to display video output of the one or more actors in the set of actors on a display device during play of the game.

24. The method of claim 23, further comprising creating re-creation software configured to retrieve saved state data for the one or more actors from the memory, wherein the saved state data comprises saved values for the parameters, re-create the video output by applying the saved state data to one or more actors used to recreate the video output, and display the re-created video output on the display device.

25. The method of claim 23, wherein the state data includes values for the parameters that define a three-dimensional video presentation status for a three-dimensional actor in a three-dimensional environment.

26. The method of claim 23, wherein the software is further configured to move an actor in the set of actors on the display device over time with game play.

27. The method of claim 23, further comprising establishing a database in a server configured to communicate with the gaming machine.

28. The method of claim 27, wherein the saved state data is indexed in the database using one of: a number identifying the game, a number identifying the gaming machine, and a time that the game was played.

29. The method of claim 23, wherein the re-creation software is configured to re-create video output substantially identical to the video output which the gaming machine displays.

30. A computer readable medium including instructions for recreating video output for a game played on a gaming machine, the method comprising:

instructions for storing, in response to an occurrence of an event of interest for the game, state data in memory for an actor displayed using a video device for the gaming machine, wherein:

the event of interest occurs during the game and prior to an outcome of the game, a presentation status of the actor when the event of interest occurred is generated by applying the state data to the actor, and the state data characterizes a position, a rotational orientation, and a scale for the actor;

instructions for recalling the state data from the memory;

instructions for re-creating the video output for the game by applying the state data to the actor; and instructions for displaying the re-created video output.

31. The method of claim 30, further comprising instructions for transmitting the state data from the gaming machine to a server remote from the gaming machine and configured to store the state data.

32. A gaming machine, comprising:

an external cabinet defining an interior region of the gaming machine;

a video device adapted to display video output for the game, the video device being located within or about the external cabinet;

a memory located within the external cabinet, the memory including instructions for storing state data in the memory for an actor in a game displayed using the video device for the gaming machine in response to an event of interest occurring in the game on the gaming machine, wherein:

the event of interest occurs during the game and prior to an outcome of the game, a presentation status of the actor when the event of interest occurred is generated by applying the state data to the actor, and the state data characterizes a position, a rotational orientation, and a scale for the actor; and a main processor disposed within the external cabinet and configured to output the game to the video device and configured to:

a) recall the state data from the memory; and b) re-create the video output for the game by applying the state data to the actor.

33. The gaming machine of claim 32 wherein the memory is a non-volatile memory source that retains data stored therein in the event that the gaming machine experiences a power failure.

34. The gaming machine of claim 32 further comprising a communications interface that permits the gaming machine to communicate across a network with a server.

35. The gaming machine of claim 32 further comprising game logic that renders a two-dimensional image of a three-dimensional actor and wherein the video device is substantially two-dimensional.

36. The gaming machine of claim 35 wherein the state data includes data that describes a three-dimensional presentation status of the three-dimensional actor in a three-dimensional environment model.

37. The gaming machine of claim 32 wherein the video output depicts the actor moving on the video device over time with play of the game.

38. The gaming machine of claim 32 wherein the game is selected from the group consisting of a slot game, a keno game, a poker game, a pachinko game, a video black jack game, a bingo game, a baccarat game, a roulette game, a dice game and a card game.

39. The gaming machine of claim 32 wherein the re-created video output is identical to the video output displayed by the display device when the event of interest occurred.

40. A gaming system, comprising:

a) a gaming machine connected to a network, the gaming machine comprising:

a video device adapted to display video output for the game, a gaming machine memory including instructions for transmitting, in response to an event of interest occurring in the game on the gaming machine, state data for an actor to a server over the network, wherein:

the event of interest occurs during the game and prior to an outcome of the game, a presentation status of the actor when the event of interest occurred is generated by applying the state data to the actor, and the first state data characterizes a position, a rotational orientation, and a scale for the actor, a main processor configured to provide the video output for the game to the video device and additionally configured to re-create the video output for the game by applying the transmitted state data to the actor, wherein the transmitted state data is retrieved from the server, and a communications interface that permits the gaming machine to communicate across the network with the server; and b) the server, comprising:

a server communications interface for transmitting state data to, and receiving state data from, the one or more gaming machines on the network, and a server memory that stores a database, wherein the database is configured to store the state data transmitted to the server by the gaming machine.

41. The system of claim 40 wherein the server is geographically remote from the gaming machine.

42. The system of claim 40 wherein the gaming machine memory is a non-volatile memory source that retains state data stored therein in the event that the gaming machine experiences a power failure.

43. The system of claim 40 wherein the gaming machine memory further comprises game logic that renders a two-dimensional image of a three-dimensional actor of the game and wherein the video device is substantially two-dimensional.

44. The system of claim 40 wherein the state data is indexed in the database using one of: a number for the game, a number for the gaming machine, and a time that the game was played.

* * * * *